US011105311B2

(12) United States Patent
Nakamura et al.

(10) Patent No.: US 11,105,311 B2
(45) Date of Patent: Aug. 31, 2021

(54) IGNITION DEVICE FOR INTERNAL COMBUSTION ENGINE

(71) Applicant: Mitsubishi Electric Corporation, Tokyo (JP)

(72) Inventors: Toshifumi Nakamura, Tokyo (JP); Takahiko Inada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/036,347

(22) Filed: Sep. 29, 2020

(65) Prior Publication Data

US 2021/0222665 A1 Jul. 22, 2021

(30) Foreign Application Priority Data

Jan. 16, 2020 (JP) ..... JP2020-004846

(51) Int. Cl.
*F02P 3/05* (2006.01)
*F02P 3/09* (2006.01)
(Continued)

(52) U.S. Cl.
CPC ..... *F02P 17/12* (2013.01); *F02P 3/051* (2013.01); *F02P 3/053* (2013.01); *F02P 3/09* (2013.01);
(Continued)

(58) Field of Classification Search
CPC .... F02P 3/051; F02P 3/053; F02P 3/09; F02P 17/12; F02P 2017/121; F02P 2017/125
(Continued)

(56) References Cited

U.S. PATENT DOCUMENTS 7,644,707 B2 * 1/2010 Kraus ..... F02P 9/007 123/623
9,470,202 B2 * 10/2016 Torrisi ..... F02P 17/12
(Continued)

FOREIGN PATENT DOCUMENTS

JP 2012-207669 A 10/2012
JP 201311181 A 1/2013
(Continued)

OTHER PUBLICATIONS

Communication dated Mar. 30, 2021, from the Japanese Patent Office in application No. 2020-004846.

*Primary Examiner* — Erick R Solis
(74) *Attorney, Agent, or Firm* — Sughrue Mion, PLLC; Richard C. Turner

(57) ABSTRACT

An ignition device for an internal combustion engine includes an ignition coil, a first switch, a secondary current adjuster, and controller The ignition coil includes a primary coil, a core, and a secondary coil. The first switch switches an energized state of the primary coil between an ON state and an OFF state. The secondary current adjuster adjusts a current value of a secondary current flowing through the secondary coil. The controller controls the secondary current adjuster so that a current value of the secondary current in at least a part of a charging period of the ignition plug, which is a period from when the energized state of the primary coil is switched from the ON state to the OFF state by the first switch to when dielectric breakdown occurs in the ignition plug, becomes smaller than a peak value of the secondary current after the dielectric breakdown occurs.

20 Claims, 12 Drawing Sheets

(51) Int. Cl.

| | |
|---|---|
| ***F02P 17/12*** | (2006.01) |
| ***F02P 15/10*** | (2006.01) |
| *F02D 41/20* | (2006.01) |
| *F02P 3/055* | (2006.01) |

(52) U.S. Cl.
CPC ..... *F02P 15/10* (2013.01); *F02D 2041/2058* (2013.01); *F02P 3/055* (2013.01); *F02P 2017/121* (2013.01); *F02P 2017/125* (2013.01)

(58) Field of Classification Search
USPC ..... 123/623, 644
See application file for complete search history.

(56) References Cited

U.S. PATENT DOCUMENTS

| | | | | |
|---|---|---|---|---|
| 9,726,140 | B2 | 8/2017 | Okuda | |
| 10,288,033 | B2 * | 5/2019 | Toriyama | F02P 9/00 |
| 2004/0200463 | A1 * | 10/2004 | Ando | F02P 11/06 123/630 |
| 2013/0335864 | A1 * | 12/2013 | Trecarichi | H03K 17/166 361/36 |
| 2019/0040834 | A1 * | 2/2019 | Nishio | F02P 3/05 |
| 2020/0318599 | A1 * | 10/2020 | Nakamura | F02P 15/10 |
| 2021/0082618 | A1 * | 3/2021 | Muramoto | F02P 5/04 |

FOREIGN PATENT DOCUMENTS

| | | | |
|---|---|---|---|
| JP | 2016-65462 | A | 4/2016 |
| JP | 20183635 | A | 1/2018 |

* cited by examiner

IGNITION DEVICE FOR INTERNAL COMBUSTION ENGINE

BACKGROUND OF THE INVENTION

1. Field of the Invention

The present disclosure relates to an ignition device for an internal combustion engine.

2. Description of the Related Art

Hitherto, there is known an ignition device for an internal combustion engine, which is configured to detect an abnormality in dielectric breakdown voltage of an ignition plug, a misfire in the internal combustion engine, or other incidents. The dielectric breakdown voltage is a secondary voltage generated on a secondary coil side of an ignition coil at a moment when dielectric breakdown occurs between electrodes of the ignition plug. For example, in an internal combustion engine control apparatus of the related art, a primary voltage generated on a primary coil side of the ignition coil is measured, and a dielectric breakdown voltage is measured indirectly based on a period in which the measured primary voltage exceeds a reference voltage (see Japanese Patent Application Laid-open No. 2016-65462, for example).

In recent years, in order to secure combustibility of a lean air-fuel mixture in an internal combustion engine operated on the lean air-fuel mixture, an ignition device for the internal combustion engine with which a larger secondary current can generated is desired However, as a result of intensive studies by the inventors, it is found. that, when a current value of the More specifically, a period from when the primary current is interrupted to when the dielectric breakdown occurs depends on electrostatic capacitance on the secondary coil side including the ignition plug. When the primary current is interrupted, the secondary current is generated by magnetic energy stored in a core of the ignition coil. As the current value of the secondary current becomes larger, a charging speed of the electrostatic capacitance on the secondary coil side becomes higher. Therefore, as the current value of the secondary current becomes larger, the period from when the primary current is interrupted to when the dielectric breakdown occurs becomes shorter. The period from when the primary current is interrupted to when the dielectric breakdown occurs is hereinafter referred to as a "charging period".

Meanwhile, the noise superimposed on the primary voltage is generated mainly due to leakage inductance of the primary coil irrespective of the current value of the secondary current. Therefore, even when the current value of the secondary current is changed, a primary interruption nose generation period, which is a period in which the noise superimposed on the primary voltage is generated, is not changed. Therefore, the charging period may become shorter than the primary interruption noise generation period in some cases.

As described above, in the ignition device for an internal combustion engine in which the secondary current is increased to such an extent that the charging period becomes shorter than the primary interruption noise generation period, a signal of the primary voltage in the charging period may be buried in primary interruption noise to be undetectable in some cases. Therefore, in this case, it becomes difficult to measure a secondary voltage in the charging period and the dielectric breakdown voltage indirectly.

SUMMARY OF THE INVENTION

The present disclosure has been made to solve the above-mentioned problem, and therefore has an object to provide an ignition device for an internal combustion engine that can suppress difficulty in measuring a primary voltage of an ignition coil.

An ignition device for an internal combustion engine according to the present disclosure includes: an ignition coil including a primary coil, a core, and a secondary coil, which is magnetically coupled to the primary coil via the ore, and is configured to supply power to an ignition plug; a first switch configured to switch an energized state of the primary coil between an ON state and an OFF state; a secondary current adjuster configured to adjust a current value of a secondary current flowing through the secondary coil; and a controller configured to control the secondary current adjuster so that a current value of the secondary current in at least a part of a charging period of the ignition plug, which is a period from when the energized state of the primary coil is switched from the ON state to the OFF state by the first switch to when dielectric breakdown occurs in the ignition plug, becomes smaller than a peak value of the secondary current after the dielectric breakdown occurs.

According to the ignition device for an internal combustion engine of the present disclosure, difficulty in measuring the primary voltage of the ignition coil is suppressed.

BRIEF DESCRIPTION OF THE DRAWINGS

FIG. 3 is a timing chart for illustrating operation of the ignition device for an internal combustion engine of FIG. 7.

FIG. 3 is a configuration diagram for illustrating an ignition device for an internal combustion engine according to a fifth embodiment.

DESCRIPTION OF THE EMBODIMENTS

In the following, embodiments are described with reference to the drawings

First Embodiment.

Figure 1:
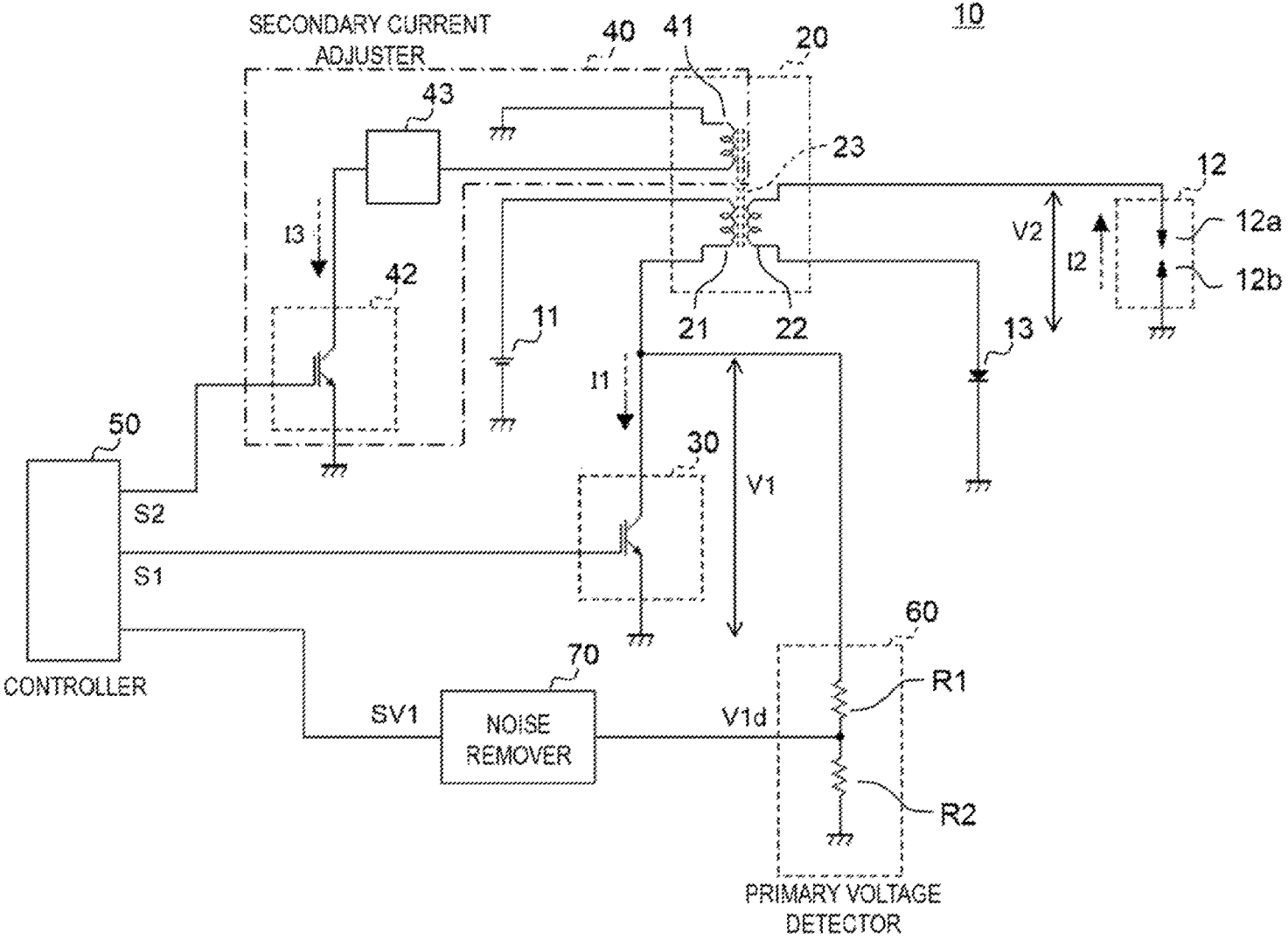
FIG. 1 is a configuration diagram for illustrating an ignition device for an internal combustion engine according to a first embodiment.

FIG. 1 is a configuration diagram for illustrating an ignition device for an internal combustion engine according to a first embodiment. As illustrated in FIG. 1, an ignition device 10 for an internal combustion engine includes an ignition coil 20, a first switch 30, a secondary current adjuster 40, a controller 50, a primary voltage detector 60, and a noise remover 70.

The ignition coil 20 includes a primary coil 21, a secondary coil 22, and a core 23. The primary coil 21 is wound around the core 23.

The primary coil 21 has a high-voltage side terminal connected to a positive terminal of a DC power supply 11. The DC power supply 11 has a negative terminal connected to the ground. As the DC power supply 11, a lead-acid battery is used, for example. The DC power supply 11 is configured to output a rated power supply voltage of 12 V. The primary coil 21 is supplied with electric power from the DC power supply 11.

The primary coil 21 has a low-voltage side terminal connected to the ground via the first switch 30. The first switch 30 is an insulated gate bipolar transistor (IGBT), for example. The first switch 30 is configured to switch an energized state of the primary coil 21 between an ON state and an OFF state.

The secondary coil 22 is wound around the core 23. Therefore, the secondary coil 22 is magnetically coupled to the primary coil 21 via the core 23. The number of turns N2 of the secondary coil 22 is larger than the number of turns N1 of the primary coil 21. A winding turns ratio RN12 of the secondary coil 22 to the primary coil 21 is N2/N1.

The secondary coil 22 has a high-voltage side terminal connected to a first electrode 12*a* of an ignition plug 12. The secondary coil 22 has a low-voltage side terminal connected to an anode of a backflow prevention diode 13. The backflow prevention diode 13 has a cathode connected to the ground. Therefore, the backflow prevention diode 13 is configured to block an electric current flowing from the ground to the secondary coil 22 while passing an electric current flowing from the secondary coil 22 to the ground.

The core 23 is configured to store magnetic energy generated when the primary coil 21 is energized. The secondary coil 22 is configured to supply electric power based on the magnetic energy stored in the core 23 to the ignition plug 12.

The ignition plug 12 has the first electrode 12*a* and a second electrode 12*b*. The first electrode 12*a* and the second electrode 12*b* are opposed to each other via a gap. The ignition plug 12 is provided in the internal combustion engine so that the first electrode 12*a* and the second electrode 12*b* are exposed inside a combustion chamber of the internal combustion engine. The ignition plug 12 is used to ignite a combustible air-fuel mixture. The combustible air-fuel mixture is formed in the combustion chamber.

The secondary current adjuster 40 includes an adjusting coil 41, a second switch 42, and a first current limiter 43. The secondary current adjuster 40 is configured to adjust a current value of a secondary current T2. The secondary current I2 is an electric current flowing through the secondary coil 22 toward the ground.

The adjusting coil 41 is wound around the core 23. Therefore, the adjusting coil 41 is magnetically coupled to the primary coil 21 and the secondary coil 22. The adjusting coil 41 is energized to generate magnetic energy in the core 23. The adjusting coil 41 has one end connected to the ground. The adjusting coil 41 has another end connected to the ground via the first current limiter 43 and the second switch 42.

The second switch 42 is an IGBT, for example. The second switch 42 is configured to switch an energized state of the adjusting coil 41 between an ON state and an OFF state.

The first current limiter 43 is configured to limit an adjusting current I3 to a first upper limit value or less. The adjusting current I3 is an electric current flowing through the adjusting coil 41. The first current limiter 43 is a known clamp circuit, for example.

The controller 50 is configured to cause the first switch 30 to set the energized state of the primary coil 21 to one of the ON state and the OFF state. The controller 50 is configured to transmit a first command signal S1 to a gate terminal of the first switch 30. The first command signal S1 is a signal having two values of a high level and a low level.

When the first command signal S1 of the high level is input to the gate terminal of the first switch 30, the energized state of the primary coil 21 is set to the ON state. When the first command signal S1 of the low level is input to the gate terminal of the first switch 30, the energized state of the primary coil 21 is set to the OFF state.

When the energized state of the primary coil 21 is set to the ON state by the controller 50, a primary current I1 flows through the primary coil 21, and the electric power is supplied from the DC power supply 11 to the primary coil 21. When the energized state of the primary coil 21 is set to the OFF state by the controller 50, the primary current I1 is interrupted. In other words, the supply of the electric power from the DC power supply 11 to the primary coil 21 is stopped.

The controller 50 is configured to cause the second switch 42 to set the energized state of the adjusting coil 41 to one of the ON state and the OFF state. The controller 50 is configured to transmit a second command signal S2 to a gate terminal of the second switch 42. The second command signal S2 is a signal having two values of a high level and a low level.

When the second command signal S2 of the high level is input to the gate terminal of the second switch 42, the energized state of the adjusting coil 41 is set to the ON state. When the second command signal S2 of the low level is input to the gate terminal of the second switch 42, the energized state of the adjusting coil 41 is set to the OFF state.

When the energized state of the adjusting coil 41 is set to the ON state by the controller 50, the adjusting current I3 flows from the ground to the adjusting coil 41. When the energized state of the adjusting coil 41 is set to the OFF state by the controller 50, the adjusting current I3 is interrupted.

The adjusting coil 41 is wound around the core 23 so that, when the adjusting current I3 flowing from the ground to the adjusting coil 41 is generated, a magnetic flux is generated in the same direction as a direction of a magnetic flux generated in the core 23 by the primary coil 21.

In other words, the adjusting coil 41 is wound around the core 23 so that the direction of the magnetic flux generated in the core 23 by the adjusting current I3 is the same as the direction of the magnetic flux generated in the core 23 by the primary current I1.

The primary voltage detector 60 is connected to the low-voltage side terminal of the primary coil 21 in parallel to the first switch 30. The primary voltage detector 60 includes a first resistor RI and a second resistor R2. The first resistor RI has one end connected to the low-voltage side terminal of the primary coil 21. The second resistor R2 has one end connected to another end of the first resistor RI. The second resistor R2 has another end connected to the ground.

The primary voltage detector 60 is configured to detect a primary voltage V1. The primary voltage V1 is a voltage generated at a coil end of the primary coil 21 that is opposite to a coil end thereof that is connected to the DC power supply 11. The primary voltage detector 60 is configured to output, as an output signal V1*d*, a potential at a connection point between the first resistor RI and the second resistor R2. The primary voltage detector 60 is a resistance voltage divider. The output signal V1*d* of the primary voltage detector 60 is calculated by the following expression (1).

$$V1d=RR1\times V1 \quad (1)$$

In the expression (1), RR1 is a voltage dividing ratio, and is calculated by the following expression (2).

$$RR1=R2/(R1+R2) \quad (2)$$

Incidentally, when the primary current I1 is interrupted by the first, switch 30, noise is superimposed on the output signal V1*d* of the primary voltage detector 60. This noise is caused by leakage inductance of the primary coil 21, ringing of the primary current I1, or the like. This noise is noise generated when the primary current I1 is interrupted, and hence is hereinafter referred to as "primary current interruption noise".

The noise remover 70 is configured to remove the primary current interruption noise from the output signal V1*d* of the primary voltage detector 60. The noise remover 70 is configured to set a mask period to include a noise generation period. The noise generation period is a period in which the primary current interruption noise is generated. The noise remover 70 is configured to mask the output signal V1*d* of the primary voltage detector 60 in the mask period to remove the primary current interruption noise. Then, the noise remover 70 is configured to transmit an output signal SV1 to the controller 50. The output signal SV1 of the noise remover 70 is an output obtained by removing the primary current interruption noise from the output signal V1*d* of the primary voltage detector 60.

More specifically, the primary current interruption noise is increased abruptly immediately after the state of the first switch 30 is switched from the ON state to the OFF state, and is then reduced abruptly. Therefore, the noise remover 70 is configured to detect a rising edge and a falling edge of the primary current interruption noise in the output signal V1*d* of the primary voltage detector 60 to detect the noise generation period.

The noise remover 70 is further configured to replace, as mask processing, a voltage value of the output signal V1*d* of the primary voltage detector 60 in the noise generation period to a value that is sufficiently lower than a voltage value generated at the time of dielectric breakdown, for example, 0 V.

Figure 2:
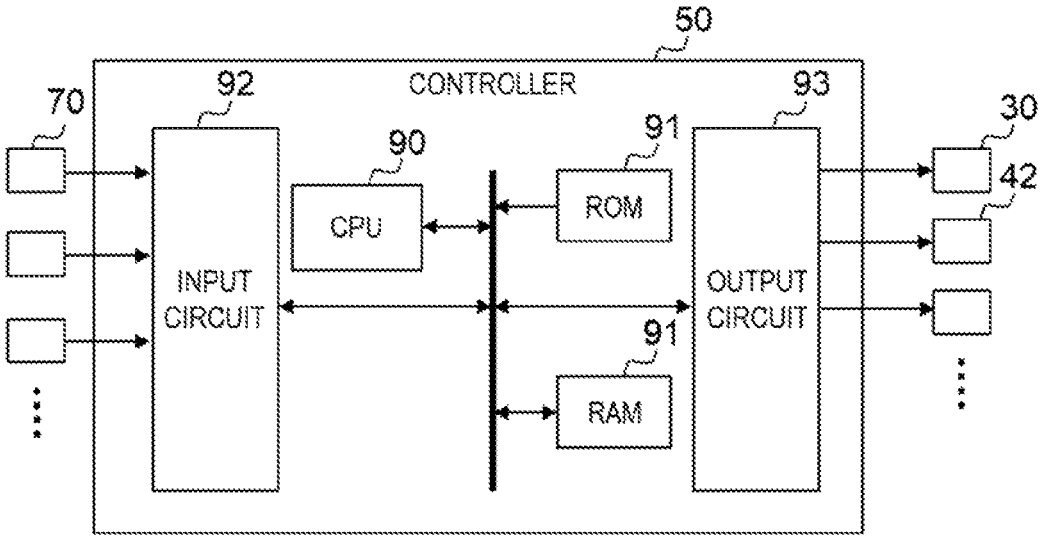
FIG. 2 is a hardware configuration diagram of a processing circuit configured to achieve functions of a controller of the ignition device for an internal combustion engine according to the first embodiment.

FIG. 2 is a hardware configuration diagram of a processing circuit configured to achieve the functions of the controller 50. The functions of the controller 50 are achieved by an internal combustion engine control apparatus configured to control the internal combustion engine. As illustrated in FIG. 2, the internal combustion engine control apparatus includes an arithmetic processor 90, a storage device 91, an input circuit 92, an output circuit 93, and other components.

The arithmetic processor 90 is a central processing unit (CPU), for example. The storage device 91 is configured to transmit/receive data to/from the arithmetic processor 90. The input circuit 92 is configured to input signals from the outside to the arithmetic processor 90. The output circuit 93 is configured to output signals from the arithmetic processor 90 to the outside.

The arithmetic processor 90 is an application specific integrated circuit (ASIC), an integrated circuit (IC), a digital signal processor (DSP), a field programmable gate array (FPGA), various logic circuits, various signal processing circuits, or the like. Alternatively, the arithmetic processor 90 may include a plurality of logic circuits or signal processing circuits of the same type, a plurality of logic circuits or signal processing circuits of different types, or the like to execute processes in a shared manner.

The internal combustion engine control apparatus includes, as the storage device 91, a random access memory (RAM), a read only memory (ROM), and the like. The RAM is configured so that data is readable and writable from and to the arithmetic processor 90. The ROM is configured so that data is readable from the arithmetic processor 90.

The input circuit 92 is connected to various sensors, such as a crank angle sensor, a cam angle sensor, an intake air amount detecting sensor, a water temperature sensor, and a power supply voltage sensor, and to various switches. The input circuit 92 is also connected to the noise remover 70. The input circuit 92 includes an A/D converter. The A/D converter is configured to convert analog signals from the above-mentioned various sensors, switches, and noise remover 70 into digital signals to be input to the arithmetic processor 90.

The output circuit 93 is connected to the first switch 30, the second switch 42, and an injector or other electric load. The output circuit 93 includes a drive circuit. The drive circuit is configured to output a control signal from the arithmetic processor 90 to the above-mentioned electric load.

The functions of the controller 50 are achieved by the arithmetic processor 90 executing programs stored in the storage device 91, for example, the ROM and the RAM, and cooperating with other hardware, for example, the input circuit 92 and the output circuit 93.

The controller 50 is configured to calculate, as basic control, a fuel injection amount, an ignition timing, and the like based on the input signals from the various sensors. The controller 50 is configured to then control the first switch 30, the second switch 42, the injector, and the like to be driven.

Some of the functions of the internal combustion engine control apparatus may be achieved by special-purpose hardware, and others may be achieved by software or firmware.

As described above, the processing circuit can achieve the functions of the internal combustion engine control apparatus by hardware, software, firmware, or a combination thereof.

Figure 3:
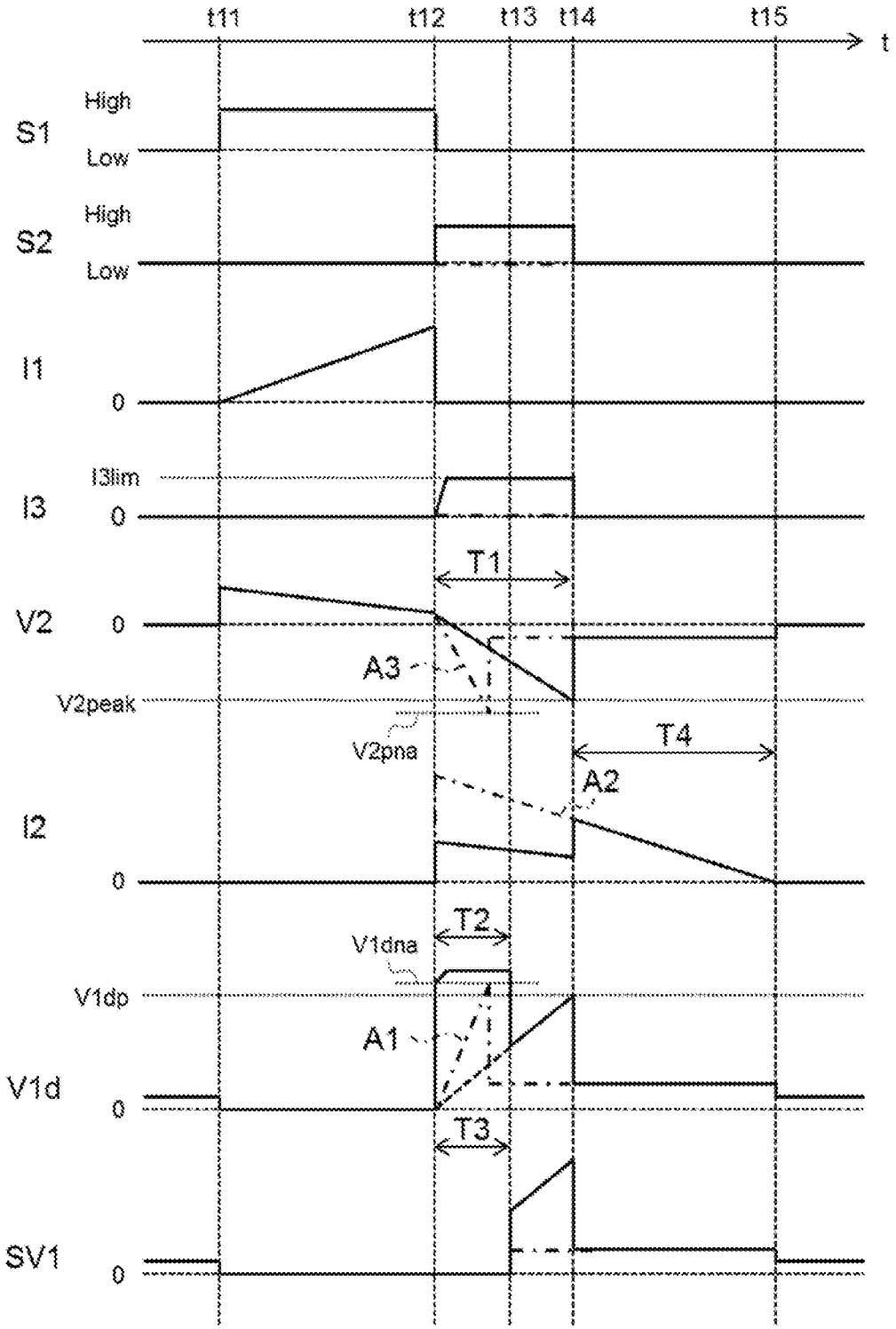
FIG. 3 is a timing chart for illustrating operation of the ignition device for an internal combustion engine of FIG. 1.

FIG. 3 is a timing chart for illustrating operation of the ignition device 10 for an internal combustion engine according to the first embodiment. When an ignition timing determined separately comes, the controller 50 switches the first command signal S1 for the first switch 30 from the low level to the high level at Time t11. As a result, the energized state of the primary coil 21 is switched from the OFF state to the ON state, and the primary current I1 starts to flow through the primary coil 21.

The primary current I1 is increased with a slope based on inductance of the primary coil 21 and the primary voltage V1. Further, the magnetic energy is stored in the core 23.

Thereafter at Time t12, the controller 50 switches the first command signal S1 from the high level to the low level. As a result, the energized state of the primary coil 21 is switched from the ON state to the OFF state, and the primary current I1 is interrupted.

At this time, the primary current interruption noise is generated, and the output signal V1*d* of the primary voltage detector 60 is increased abruptly. Thereafter at Time t13, the primary current interruption noise disappears, and the output signal V1*d* of the primary voltage detector 60 is reduced abruptly A period from when the output signal V1*d* of the primary voltage detector 60 is increased abruptly to when the output signal V1*d* is reduced abruptly is a noise generation period T2.

Also at Time t12, the controller 50 switches the second command signal S2 for the second switch 42 from the low level to the high level. As a result, the energized state of the adjusting coil 41 is switched from the OFF state to the ON state, and the adjusting current I3 starts to flow through the adjusting coil 41.

As described above, the adjusting coil 41 is wound around the core 23 so that, when the adjusting current I3 is generated, the magnetic flux is generated in the same direction as the direction of the magnetic flux generated in the core 23 by the primary coil 21. Therefore, when the adjusting current I3 flows through the adjusting coil 41, the secondary current I2 is reduced. More specifically, a relationship of the following expression (3) is established among the primary current I1, the secondary current I2, and the adjusting current I3. N3 represents the number of turns of the adjusting coil 41.

$$N1 \times I1 = N2 \times I2 + N3 \times I3 \quad (3)$$

When the primary current I1 does not change, as the adjusting current I3 is increased, the secondary current I2 is reduced.

Further, when the secondary current I2 is reduced, a speed at which electrostatic capacitance formed in a path of the secondary current I2 is charged is reduced. This electrostatic capacitance includes electrostatic capacitance formed between the first electrode 12*a* and the second electrode 12*b* of the ignition plug 12. A magnitude of a secondary voltage V2 is increased gradually as the electrostatic capacitance is charged more.

Incidentally, when the magnetic flux generated in the core 23 by the adjusting current I3 becomes equal to or larger than the magnetic flux generated in the core 23 by the primary current I1, the secondary current I2 is stopped completely. In this case, the secondary voltage V2 does not reach a dielectric breakdown voltage V2 peak, and hence a spark discharge does not occur. In other words, a misfire occurs in the internal combustion engine. The "dielectric breakdown voltage V2peak" as used herein is a voltage across the electrodes of the ignition plug 12 at the time when the dielectric breakdown occurs in the ignition plug 12.

To address the above-mentioned problem, the first current limiter 43 limits the adjusting current I3 to the first upper limit value or less so that the magnetic flux generated in the core 23 by the adjusting current I3 becomes smaller than the magnetic flux generated in the core 23 by the primary current I1. For example, a first upper limit value I31im is calculated by the following expression (4).

$$I31im = I1 \times N1/N3 \quad (4)$$

In the expression (4), N3 represents the number of turns of the adjusting coil 41. After being increased to the first upper limit value I31im, the adjusting current I3 transitions at a constant value until Time t14.

In the output signal V1*d* of the primary voltage detector 60, the increase of the primary voltage V1 from Time t12 is indicated by the one-dot chain line A1 in FIG. 3. The increase of the primary voltage V1 indicated by the one-dot chain line A1 is hidden in the primary current interruption noise and is not observed in reality.

Further, the secondary current I2 is generated by the magnetic energy stored in the core 23. The magnetic energy is maximized at Time t12, at which the secondary current I2 is generated. Therefore, the secondary current I2 has the largest current value at Time t12. The secondary current I2 is reduced gradually from Time t12.

Now, in a period from Time t12 to Time t14, the current value of the secondary current I2 becomes smaller than, a current value of the secondary current I2 obtained in a case where no adjusting current I3 is caused to flow in the period from Time t12 to Time t14. The current value of the secondary current I2 in the case where no adjusting current I3 is caused to flow is indicated by the one-dot chain line A2 in FIG. 3.

A speed at which electric charges are stored in the electrostatic capacitance in the path of the secondary current I2 in the case where the adjusting current I3 is caused to flow is lower than a speed at which electric charges are stored in the electrostatic capacitance in the path of the secondary current I2 in the case where no adjusting current I3 is caused to flow.

As indicated by the one-dot chain line A3, a magnitude of a rate of change of the secondary voltage V2 in the case where no adjusting current I3 is caused to flow is larger than a magnitude of a rate of change of the secondary voltage V2 in the case where the adjusting current I3 is caused to flow.

In other words, a charging period in the case where no adjusting current I3 is caused to flow is shorter than a charging period T1 in the case where the adjusting current I3 is caused to flow. The "charging period T1" as used herein is a period in which the ignition plug 12 is charged, from when the energized state of the primary coil 21 is switched from the ON state to the OFF state by the first switch 30 to when the dielectric breakdown occurs in the ignition plug 12. The charging period T1 is a period from Time t12 to Time t14.

As described above, in the charging period T1, the controller 50 controls the secondary current adjuster 40 to change a rate of change of the voltage across the two electrodes of the ignition plug 12.

Further, it is generally known that, as the rate of change of the secondary voltage V2 becomes higher, the dielectric breakdown voltage becomes higher. Therefore, the dielectric breakdown voltage V2peak in the case where the adjusting current I3 flows is lower than a dielectric breakdown voltage V2*pna* in the case where the adjusting current I3 does not flow. In other words, the rate of change of the secondary voltage V2 in the case where the adjusting current I3 flows is lower than the rate of change of the secondary voltage V2 in the case where the adjusting current I3 does not flow.

As described above, the primary current interruption noise is superimposed on the primary voltage V1 because the primary current I1 is interrupted. The primary current interruption noise is observed as a peak voltage of the output signal V1*d* of the primary voltage detector 60 from Time t12 to Time t13.

The primary voltage V1 in the case where no adjusting current I3 is caused to flow is changed in accordance with a change of the secondary voltage V2. A peak value V1*dp* of the output signal V1*d* of the primary voltage detector 60 in this case is buried in the primary current interruption noise as indicated by the one-dot chain line Al. In other words, in the case where no adjusting current I3 is caused to flow, a failing edge of the output signal V1*d* of the primary voltage detector 60 at the time of the dielectric breakdown is buried in the primary current interruption noise, and hence the timing of the dielectric breakdown is not detected.

When detecting an abrupt increase of the output signal V1*d* of the primary voltage detector 60 at Time t12, the noise remover 70 starts the mask processing on the output signal V1*d* of the primary voltage detector 60. The "mask processing" as used herein is processing of setting a voltage value of the output signal SV1 of the noise remover 70 to 0 V irrespective of the voltage value of the output signal V1*d* of the primary voltage detector 60.

When detecting an abrupt reduction of the primary current interruption noise at Time t13, the noise remover 70 ends the mask processing on the primary current interruption noise. Therefore, in the output signal SV1 of the noise remover 70, the same value as the output signal V1*d* of the primary voltage detector 60 is observed at Time t13. In this manner, an end time of a mask period T3 is determined based on Time t13, at which the primary current interruption noise stops being generated.

The mask period T3 is a period from when an abrupt increase of the output signal V1*d* of the primary voltage detector 60 is detected to when an abrupt reduction of the output signal V1*d* of the primary voltage detector 60 is detected. Therefore, in the first embodiment, the mask period T3 is substantially equal to the noise generation period T2.

The controller 50 starts detecting a peak value of the output signal SV1 of the noise remover 70 from Time t13. More specifically, the controller 50 detects an abrupt reduction of the output signal SV1 of the noise remover 70 at and after Time t13. Then, the controller 50 detects, as the peak value V1*dp*, the voltage value of the output signal SV1 of the noise remover 70 obtained at the time when the abrupt reduction of the output signal SV1 of the noise remover 70 is detected.

When the secondary voltage V2 reaches the dielectric breakdown voltage V2peak at Time t14, a spark discharge occurs between the first electrode 12*a* and the second electrode 12*b*. The charging period T1 from Time t12 to Time t14 is from about several microseconds to about several tens of microseconds.

As a result., the secondary voltage V2 is increased abruptly toward 0 V. The primary voltage V1 is abruptly reduced in accordance with an increase of the secondary voltage V2 at Time t14. The peak value V1*dp* of the output signal V1*d* of the primary voltage detector 60 at Time t14 indicates the primary voltage V1 generated at the time when the dielectric breakdown occurs.

Therefore, the controller 50 detects the output signal SV1 of the noise remover 70 at Time t14 as the peak value V1*dp*. The controller 50 converts the detected peak value V1*dp* to the dielectric breakdown voltage V2peak. For example, the conversion from the output signal SV1 of the noise remover 70 to the secondary voltage V2 is performed by the following expressions (5) and (6).

$$V2=RN12\times(SV1/RR1 \quad (5)$$

$$RN12=N2/N1 \quad (6)$$

When a coupling coefficient between the primary coil 21 and the secondary coil 22 is corrected based on an operation state of the internal combustion engine, and on temperature characteristics of the primary coil 21 and the secondary coil 22, the dielectric breakdown voltage V2peak is calculated more accurately.

When detecting the peak value V1*dp* of the output signal SV1 of the noise remover 70, the controller 50 switches the second command signal S2 from the high level to the low level. As a result, the adjusting current I3 is interrupted. In other words, the controller 50 ends the control for reducing the secondary current I2 at Time t14.

At Time t14, the secondary current I2 is increased abruptly, and hence a spark discharge of high energy occurs. Thereafter, as the magnetic energy stored in the core 23 is reduced, the secondary current I2 is reduced gradually. Then, at Time t15, all the magnetic energy is consumed, the secondary current I2 becomes zero, and the spark discharge ends. The period from when the spark discharge occurs to when the spark discharge ends is referred to as a "discharge period T4".

As described above, the controller 50 of the ignition device 10 for an internal combustion engine according to the first embodiment is configured to control the secondary current adjuster 40 so that the current value of the secondary current 12 in the charging period T1 becomes smaller than a peak value of the secondary current I2 obtained after the dielectric breakdown occurs. In other words, the controller 50 is configured to control the secondary current adjuster 40 so that the charging period T1 is at least longer than the period in which the primary current interruption noise is generated.

With the above-mentioned configuration, the secondary current I2 in the charging period T1 is controlled without significantly affecting the secondary current I2 in the discharge period T4. As a result, the rate of change of the secondary voltage V2 in the charging period T1 is controlled without significantly affecting the secondary current I2 in the discharge period T4.

Therefore, in the output signal V1*d* of the primary voltage detector 60, the peak voltage of the primary voltage V1 at the time of the dielectric breakdown is suppressed from being buried in the primary current interruption noise. A peak voltage of the primary voltage V1 at the time of the dielectric breakdown becomes easier to detect. Consequently, it is possible to suppress difficulty in measuring the primary voltage V1 of the ignition coil 20.

As a result, the dielectric breakdown voltage V2peak can be estimated even in a device in which the current value of the secondary current becomes large at the time of the spark discharge, and in which the spark discharge of high energy occurs.

Further, the rate of change of the secondary voltage V2 is reduced to reduce the dielectric breakdown voltage V2peak. As a result, an electric current at the time of the discharge is reduced, and hence the melting and the wearing of the first electrode 12*a* and the second electrode 12*b* of the ignition plug 12 are further suppressed.

Further, such an analog voltage signal as the output signal V1*d* of the primary voltage detector 60 obtained as a result of dividing the primary voltage V1 is converted into a digital signal with the use of an A/D converter. Then, the signal obtained as a result of the conversion into the digital signal is subjected to arithmetic processing in an electronic control unit (ECU). When the charging period becomes longer, the number of times of sampling in the A/D converter is increased, and hence computational accuracy of the dielectric breakdown voltage V2peak is increased.

In the first embodiment, the controller 50 has controlled the secondary current I2 over the entirety of the charging period T1. However, when the secondary current I2 is reduced excessively in the charging period, a misfire may occur in some cases.

To address the above-mentioned problem, in the ignition device according to the first embodiment, the current value of the secondary current I2 in at least a part of the charging period t1 may be controlled in a range in which the charging period t1 is longer than the noise generation period T2. In other words, the controller 50 may control the secondary current adjuster 40 in at least a part of the charging period T1 to change the rate of change of the voltage across the two electrodes of the ignition plug 12.

Further, the dielectric breakdown voltage V2peak in a current ignition cycle may be predicted based on operation conditions of the internal combustion engine and the dielectric breakdown voltage in past ignition cycles. Then, under operation conditions in which it is determined that the charging period T1 exceeds a period in which it is estimated that the primary current interruption noise is generated, the control on the secondary current I2 may not be executed. In other words, the secondary current adjuster 40 may be controlled only when the charging period T1 is shorter than the period in which it is estimated that the primary current interruption noise is generated.

More specifically, the controller 50 calculates the dielectric breakdown voltage V2peak based on the primary voltage V1 acquired by the primary voltage detector 60. The controller 50 predicts the dielectric breakdown voltage V2peak in the current ignition cycle based on the dielectric breakdown voltages V2peak calculated in the past ignition cycles and current operation conditions of the internal combustion engine.

The controller 50 estimates the charging period T1 based on the predicted dielectric breakdown voltage V2peak and the rate of change of the voltage across the electrodes of the ignition plug 12. The controller 50 controls the secondary current adjuster 40 when the estimated charging period T1 is shorter than the period in which it is estimated that the primary current interruption noise is generated. With this configuration, the risk of a misfire is further reduced.

Further, the secondary current I2 may be controlled so that the secondary current I2 becomes smaller from a timing at least earlier than a timing at which the secondary voltage V2 reaches the predicted dielectric breakdown voltage V2peak. As a result, the charging period T1 is substantially elongated, the number of pieces of data sampled in the A/D converter in the charging period is increased, and sampling accuracy of the output signal SV1 of the noise remover 70 is increased.

Further, the secondary current I2 may be controlled in a range in which the secondary current I2 is not completely stopped based on the operation conditions of the internal combustion engine and the periods until the dielectric breakdown occurs in the past ignition cycles.

Further, a constant current source may be used instead of the first current limiter 43. In other words, a current value of the adjusting current I3 may be kept constant by the first current limiter 43 when the energized state of the adjusting coil 41 is the ON state.

Further, when an abnormal discharge occurs in the ignition plug 12, a current value of the secondary current I2. in the period in which the secondary current I2 is adjusted with the use of the secondary current adjuster 40 may be set to a current value that is larger than a current value of the secondary current I2 obtained when the ignition plug 12 discharges normally With this configuration, combustibility of the internal combustion engine may be given a high priority.

The abnormal discharge is a leakage, a defective discharge, or the like in the ignition plug 12. The leakage is a phenomenon in which, as a result of a reduction in insulation resistance of an insulator that is present around the first electrode 12*a*, an electric current flows between the first electrode 12*a* and the ground via the insulator before the secondary voltage V2 reaches the dielectric breakdown voltage V2peak. The defective discharge is a phenomenon in which the spark discharge occurs not between the first electrode 12*a* and the second electrode 12*b* but along a surface of the insulator.

Further, when the abnormal discharge occurs in the ignition plug 12, the control on the secondary current I2 by the secondary current adjuster 40 may be stopped. Also with this configuration, it is possible to give a high priority to the combustibility of the internal combustion engine.

Still further, the method of determining the mask period T3 for masking the primary current interruption noise in the noise remover 70 is not limited to the above-mentioned method. For example, a map in which a relationship between the operation state of the internal combustion engine and the mask period T3 is defined may be generated and stored in advance by simulation, experiments, or the like. With this configuration, the mask period T3 is determined through application of an actual operation state of the internal combustion engine to the above-mentioned map. The "operation conditions of the internal combustion engine" are a temperature of cooling water, engine speed, an engine load, and the like of the internal combustion engine. Yet further, IGBTs are used as the first switch 30 and the second switch 42, but other transistors may be used.

Yet further, the noise remover 70 is provided outside the controller 50 in the first embodiment, but may be provided inside the controller 50 as a function of the controller 50.

Yet further, the dielectric breakdown voltage V2peak is obtained as a result of the conversion from the peak value V1*dp* of the output signal SV1 of the noise remover 70, but the dielectric breakdown voltage V2peak may be detected as the peak value of the secondary voltage V2 after the output signal SV1 of the noise remover 70 is converted to the secondary voltage V2.

Yet further, the noise remover 70 sets the output signal V1*d* of the primary voltage detector 60 to 0 V in the mask period T3, but the output signal V1*d* may not necessarily foe set to 0 V. For example, it is only required that the output signal SV1 of the noise remover 70 in the mask period T3 be set to a value that is low to such an extent that a peak voltage is not detected by the controller 50.

Second Embodiment

Next, an ignition device for an internal combustion engine according to a second embodiment is described.

Figure 4:
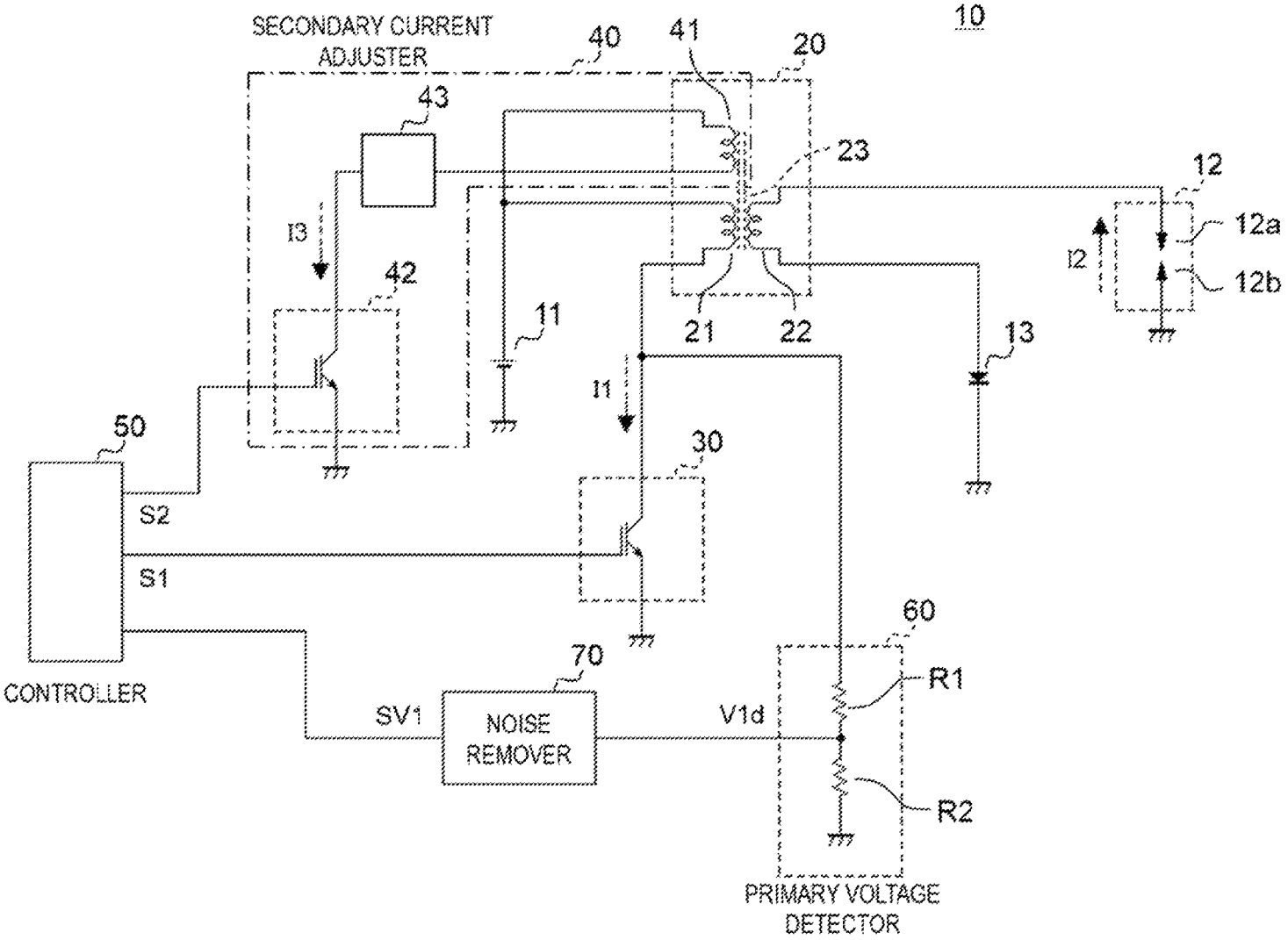
FIG. 4 is a configuration diagram for illustrating an ignition device for an internal combustion engine according to. a second embodiment.

FIG. 4 is a configuration diagram for illustrating the ignition device for an internal combustion engine according to the second embodiment. The same components as the components illustrated in FIG. 1 are denoted by the same reference symbols, and a detailed description thereof is omitted.

As illustrated in FIG. 4, the adjusting coil 41 has one end connected to the positive terminal of the DC power supply 11, and another end connected to the second switch 42. The configuration is similar to that in the first embodiment, except that the one end of the adjusting coil 41 is connected to the positive terminal of the DC power supply 11.

A direction of a magnetic flux generated in the core 23 by an electric current flowing through the adjusting coil. 41 is the same as a direction of a magnetic flux generated in the core 23 by an electric current flowing through the primary coil 21.

Operation of the ignition device for an internal combustion engine according to the second embodiment is similar to that of the ignition device 10 for an internal combustion engine according to the first embodiment, and is described with reference to the timing chart of FIG. 3. Therefore, a detailed description on the operation of the ignition device for an internal combustion engine according to the second embodiment is omitted.

With the above-mentioned configuration, as with the ignition device 10 for an internal combustion engine according to the first embodiment, the secondary current I2 in the charging period t1 is controlled without significantly affecting the secondary current I2 in the discharge period T4. As a result, the rate of change of the secondary voltage V2 in the charging period t1 is controlled without significantly affecting the secondary current I2 in the discharge period T4.

Therefore, in the output signal V1*d* of the primary voltage detector 60, a peak voltage of the primary voltage V1 at the time of the dielectric breakdown is detected without being buried in the primary current interruption noise. Consequently, it is possible to suppress difficulty in measuring the primary voltage V1 of the ignition coil 20.

With the above-mentioned configuration, it is possible to estimate the dielectric breakdown voltage even in a device in which the current value of the secondary current becomes large at the time of the spark discharge, and in which the spark discharge of high energy occurs.

Further, with the rate of change of the secondary voltage V2 being reduced, the dielectric breakdown voltage V2peak is reduced, and hence the melting and the wearing of the first electrode 12*a* and the second electrode 12*b* of the ignition plug 12 are further suppressed.

Third Embodiment

Next, an ignition device for an internal combustion engine according to a third embodiment is described.

Figure 5:
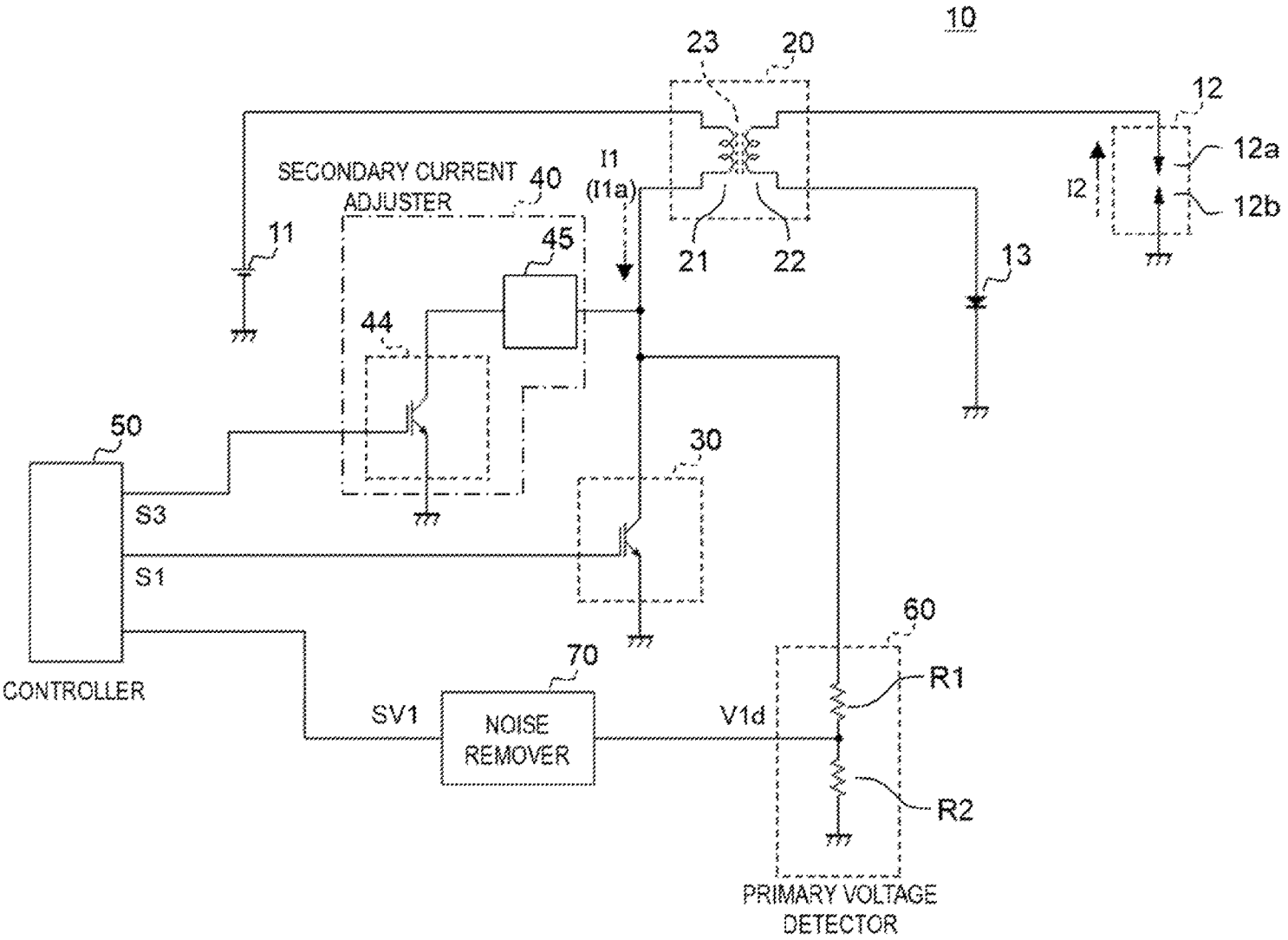
FIG. 5 is a configuration diagram for illustrating an ignition device for an internal combustion engine according to a third embodiment.

FIG. 5 is a configuration diagram for illustrating the ignition device for an internal combustion engine according to the third embodiment. The same components as the components illustrated in FIG. 1 are denoted by the same reference symbols, and a detailed description thereof is omitted.

As illustrated in FIG. 5, the secondary current adjuster 40 of an ignition device 10 for an internal combustion engine according to the third embodiment includes a third switch 44 and a second current limiter 45.

The third switch 44 is an IGBT. The third switch 44 is connected, via the second current limiter 45, to one end of the primary coil 21 that is opposite to the side of the primary coil 21 to which the DC power supply 11 is connected. In other words, the secondary current adjuster 40 is connected to the primary coil 21 in parallel to the first switch 30 between the primary coil 21 and the ground. The third switch 44 is configured to switch the energized state of the primary coil 21 between the ON state and the OFF state.

The second current limiter 45 is configured to limit the primary current I1 to a second upper limit value or less while the third switch 44 sets the energized state of the primary coil 21 to the ON state. The second current limiter 45 is a known clamp circuit, for example.

The configuration is similar to that in the first embodiment except that the third switch 44 is connected to the one end of the primary coil. 21 via the second current limiter 45, and that no adjusting coil is provided in the ignition coil 20.

A direction of a magnetic flux generated in the core 23 by the primary current T1 when the. energized state of the primary coil 21 is set to the ON state by the third switch 44 is referred to as a "first magnetic flux direction". A direction of a magnetic flux generated in the core 23 by the primary current I1 when the energized state of the primary coil 21 is set to the ON state by the first switch 30 is referred to as a "second magnetic flux direction". In this case, the first magnetic flux direction is the same as the second magnetic flux direction.

Figure 6:
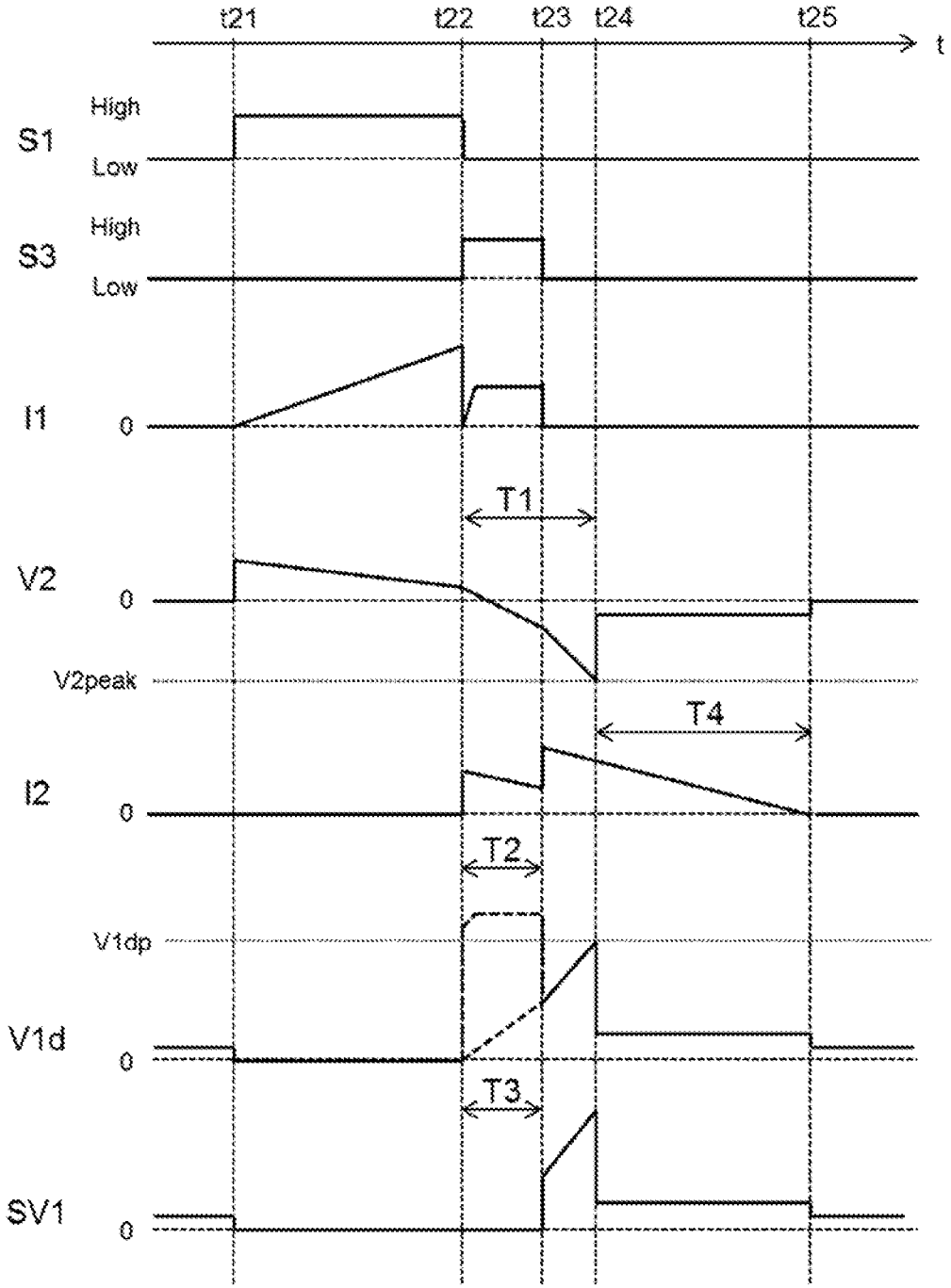
FIG. 6 is a timing chart for illustrating operation of the ignition device for an internal combustion engine of FIG. 5.

FIG. 6 is a timing chart for illustrating operation of the ignition device 10 for an internal combustion engine according to the third embodiment. When an ignition timing determined separately comes, the controller 50 switches the first command signal S1 for the first switch 30 from the low level to the high level at Time t21. As a result, the energized state of the primary coil 21 is switched from the OFF state to the ON state, and the primary current I1 starts to flow through the primary coil 21.

Thereafter at Time t22, the controller 50 switches the first command signal S1 from the high level to the low level. As a result, the energized state of the primary coil 21 is switched from the ON state to the OFF state, and the primary current I1 is interrupted.

Also at Time t22, the controller 50 switches the third command signal S3 for the third switch 44 from the low level to the high level. As a result, the energized state of the primary coil 21 is switched from the OFF state to the ON state, and a reenergization current I1*a* starts to flow through the primary coil 21.

Here, the reenergization current I1*a* is limited in current value by the second current limiter 45. Therefore, the reenergization current X1*a* is smaller than the primary current I1. A relationship among the primary current I1, the secondary current I2, and the reenergization current I1*a* is expressed by the following expression (7) based on the above-mentioned expression (3) .

$$N1 \times I1 = N2 \times I2 + N1 \times I1a \quad (7)$$

Therefore, with the reenergization current I1*a* flowing through the primary coil 21, the secondary current I2 is reduced. As a result, the rate of change of the secondary voltage V2 is reduced.

The primary coil 21 is energized, and hence a potential of the output signal V1*d* of the primary voltage detector 60 is 0 V. In other words, the primary current interruption noise is not observed in a period from Time t22 to Time t23.

The noise remover 70 is configured to determine the mask period T3 by applying the actual operation state of the internal combustion engine to a map in which a relationship between the operation state of the internal combustion engine and the mask period T3 is defined. Then, the noise remover 70 is configured to transmit the output signal SV1 to the controller 50.

The controller 50 is configured to detect a peak value V1*dp* from the output signal SV1 of the noise remover 70, and convert the detected peak value V1*dp* to a dielectric breakdown voltage V2peak.

Therefore, according to the ignition device 10 for an internal combustion engine of the third embodiment, the rate of change of the secondary voltage V2 in the charging period T1 is controlled without significantly affecting the secondary current I2 in the discharge period T4.

Therefore, in the output signal V1*d* of the primary voltage detector 60, a peak voltage of the primary voltage V1 at the time of the dielectric breakdown is detected without being buried in the primary current interruption noise. Consequently, it is possible to suppress difficulty in measuring the primary voltage V1 of the ignition coil 20.

As a result, the dielectric breakdown voltage can be estimated even in a device in which the current value of the secondary current becomes large at the time of the spark discharge, and in which the spark discharge of high energy occurs.

Further, with the rate of change of the secondary voltage V2 being reduced, the dielectric breakdown voltage V2peak is reduced, and hence the melting and the wearing of the first electrode 12*a* and the second electrode 12*b* of the ignition plug 12 are further suppressed.

Still further, it is not required to provide the adjusting coil in the ignition coil 20, and hence the ignition coil 20 can be further downsized.

In the ignition device 10 for on internal combustion engine according to the third embodiment, the third switch 44 is switched from the ON state to the OFF state at the same time as the abrupt reduction of the primary current interruption noise. However, it is only required that the third switch 44 be switched from the ON state to the OFF state in a period from Time t23, at which the primary current interruption noise is reduced abruptly, to Time t24, at which the dielectric breakdown occurs.

Further, the second current limiter 45 may be a constant current source. In other words, when the energized state of the primary coil 21 is set to the ON state by the third switch 44, a current value of the primary current I1 may be kept constant by the second current limiter 45.

Fourth Embodiment

Next, an ignition device for an internal combustion engine according to a fourth embodiment is described.

Figure 7:
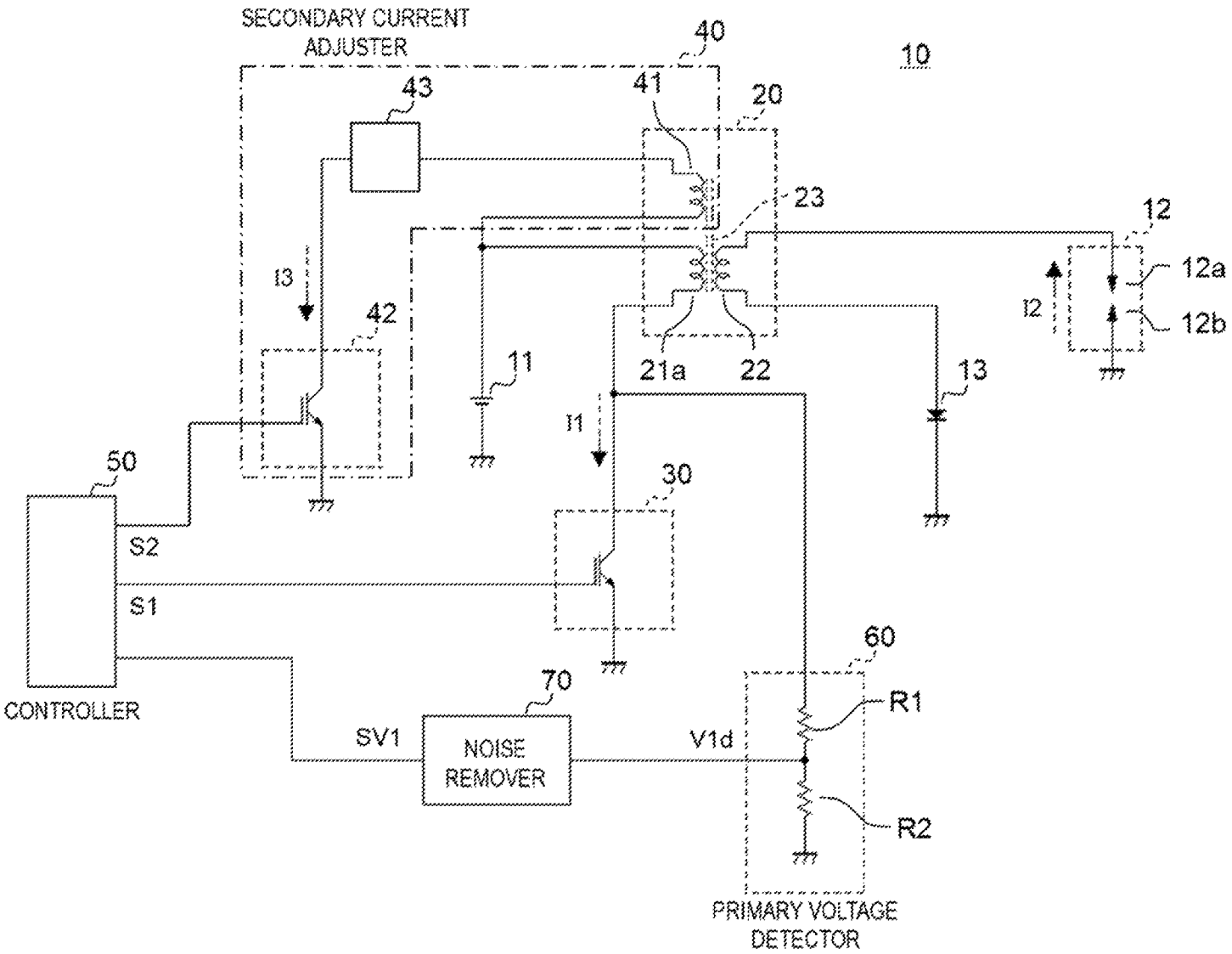
FIG. 7 is a configuration diagram for illustrating an ignition device for an internal combustion engine according to a fourth embodiment.

FIG. 7 is a configuration diagram for illustrating the ignition device for an internal combustion engine according to the fourth embodiment. The same components as the components illustrated in FIG. 1 are denoted by the same reference symbols, and a detailed description thereof is omitted.

As illustrated in FIG. 7, the secondary current adjuster 40 includes an adjusting coil 41, a second switch 42, and a first current limiter 43. The secondary current adjuster 40 is configured to adjust a current value of a secondary current I2 flowing through the secondary coil 22.

The adjusting coil 41 has one end connected to the second switch 42 via the first current limiter 43, and the adjusting coil 41 has another end connected to the DC power supply 11.

In other words, elements respectively connected to both ends of the adjusting coil 41 are interchanged from the elements respectively connected to both ends of the adjusting coil 41 in the ignition device 10 for an internal combustion engine according to the second embodiment, which is illustrated in FIG. 4.

The configuration is similar to that in the second embodiment except that the elements respectively connected to both ends of the adjusting coil 41 are interchanged from the elements respectively connected to both ends of the adjusting coil 41 in the second embodiment.

In other words, a direction of a magnetic flux generated in the core 23 by an electric current flowing through the adjusting coil 41 is opposite to a direction of a magnetic flux generated in the core 23 by an electric current flowing through a primary coil. 21*a*.

Further, the number of turns N1*a* of the primary coil 21*a* in the fourth embodiment is smaller than the number of turns N1 of the primary coil 21 in the first to third embodiments. Therefore, magnetic energy generated when the primary current I1 is caused to flow through the primary coil 21*a* becomes lower than magnetic energy generated when the primary current I1 is caused to flow through the primary coil 21 in the first to third embodiments.

Figure 8:
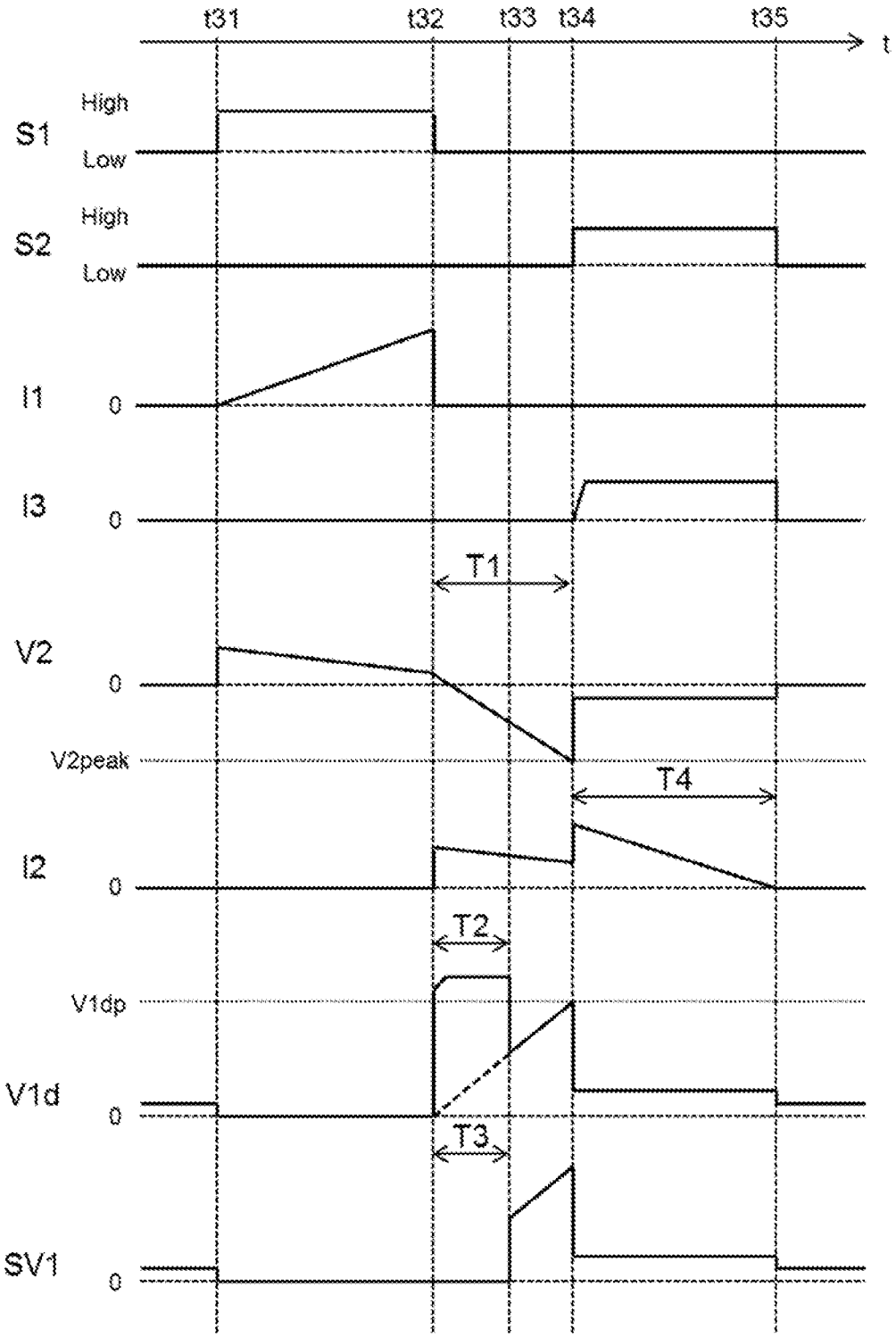

FIG. 8 is a timing chart for illustrating operation of the ignition device 10 for an internal combustion engine according to the fourth embodiment. When an ignition timing determined separately comes, the controller 50 switches the first command signal S1 for the first switch 30 from the low level to the high level at Time t31. As a result, the primary current X1 starts to flow through the primary coil 21*a*.

Thereafter at Time t32, the controller 50 switches the first, command signal S1 from the high level to the low level. As a result, the primary current I1 is interrupted.

The magnetic energy generated by the electric current flowing through the primary coil 21*a* is relatively low. Therefore, the secondary voltage V2 is changed mildly, and continues to be reduced even after Time t33, at which the primary current interruption noise is reduced abruptly. Thereafter, at Time t34, the secondary voltage V2 reaches the dielectric breakdown voltage V2peak.

Therefore, in the output signal V1*d* of the primary voltage detector 60, the peak value V1*dp* of the primary voltage V1 is observed without being hidden in the primary current interruption noise.

At Time t34, the controller 50 detects the peak value V1*dp*, and switches the second command signal S2 from the low level to the high level. As a result, the adjusting current I3 starts to flow through the adjusting coil 41. In other words, the controller 50 controls the secondary current adjuster 40 in a period at and after Time t34 being an end time of the charging period T1. More specifically, the controller 50 controls the secondary current adjuster 40 in the discharge period T4.

Here, the adjusting current I3 is limited in a current value by the first current limiter 43. A relationship among the primary current I1, the secondary current I2, and the adjusting current I3 is expressed by the following expression (8).

$$N1 \times I1 + N3 \times I3 = N2 \times I2 \quad (8)$$

Therefore, with the adjusting current I3 flowing through the adjusting coil 41, the secondary current I2 is increased. As a result, discharge energy at the time of the dielectric breakdown is increased.

Thereafter, the magnetic energy stored in the core 23 is reduced gradually, and at Time t35, the secondary current I2 becomes zero, and spark charging ends.

With the above-mentioned configuration, through the use of the primary coil 21*a* having a relatively small number of turns, the charging period T1 becomes longer than the noise generation period T2. Therefore, the peak value V1*dp* is observed in the output signal V1*d* of the primary voltage detector 60 without the adjusting current I3 being caused to flow in the charging period Tl.

Then, through the adjusting current I3 being caused to flow at a time point when the dielectric breakdown occurs in the ignition plug 12, energy of the spark discharge can be increased.

The adjusting current I3 is limited by the first current limiter 43, but in principle, the adjusting current I3 is not necessarily required to be limited in the fourth embodiment. However, it is desired that the adjusting current I3 be limited so that the ignition coil is not damaged by excessive energization of the adjusting coil 41.

Further, in the fourth embodiment, the secondary current I2 is controlled over the entirety of the discharge period T4 from Time t34, at which the dielectric breakdown occurs, to Time t35, at which the spark discharge ends, but it is not required that the secondary current I2 be controlled over the entirety of the discharge period T4.

Fifth Embodiment

Next, an ignition device for an internal combustion engine according to a fifth embodiment is described.

Figure 9:
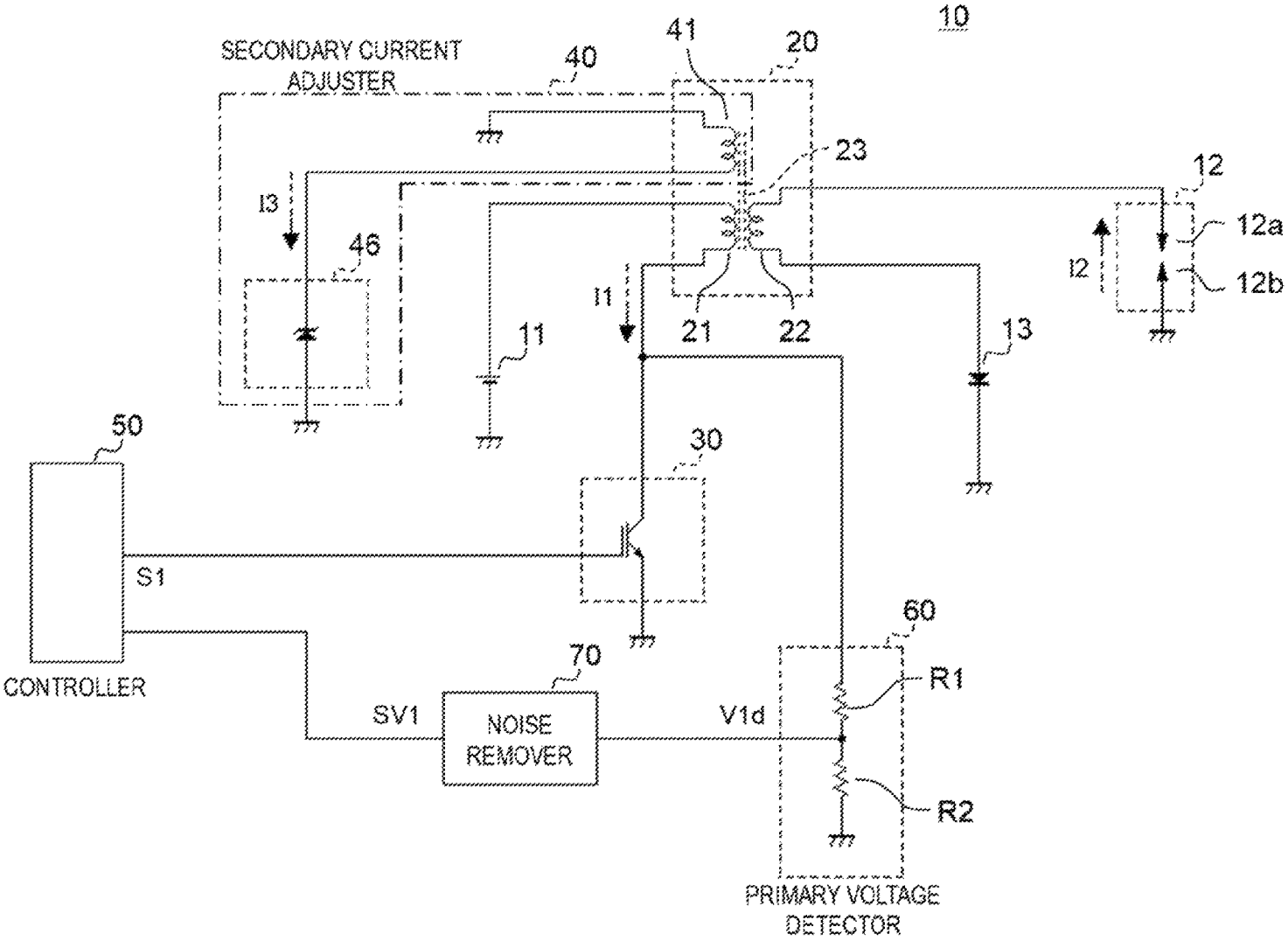

FIG. 9 is a configuration diagram for illustrating the ignition device for an internal combustion engine according to the fifth embodiment. The same components as the components illustrated in FIG. 1 are denoted by the same reference symbols, and a detailed description thereof is omitted.

As illustrated in FIG. 9, the secondary current adjuster 40 includes an adjusting coil 41 and a Zener diode 46. The secondary current adjuster 40 is configured to adjust a current value of a secondary current I2 flowing through the secondary coil 22.

The adjusting coil 41 has one end connected to the ground. The adjusting coil 41 has another end connected to a cathode of the Zener diode 46. The Zener diode 46 has an anode connected to the ground.

In other words, the configuration is similar to that in the first embodiment except that the Zener diode 46 replaces the second switch 42 and the first current limiter 43.

The Zener diode 46 conducts when a voltage between the cathode and the anode is equal to or more than a breakdown voltage Vzdi, which is a reference voltage, but does not conduct when the voltage between the cathode and the anode is less than the breakdown voltage Vzdi. The Zener diode 46 corresponds to the second switch 42.

The Zener diode 46 is configured to set the energized state of the adjusting coil 41 to the ON state when a voltage generated across both ends of the adjusting coil 41 is equal to or more than the reference voltage. The Zener diode 46 is also configured to set the energized state of the adjusting coil 41 to the OFF state when the voltage generated across both ends of the adjusting coil 41 is less than the reference voltage.

A direction of a magnetic flux generated in the core 23 by an electric current flowing through the adjusting coil 41 is the same as a direction of a magnetic flux generated in the core 23 by an electric current flowing through the primary coil 21.

Figure 10:
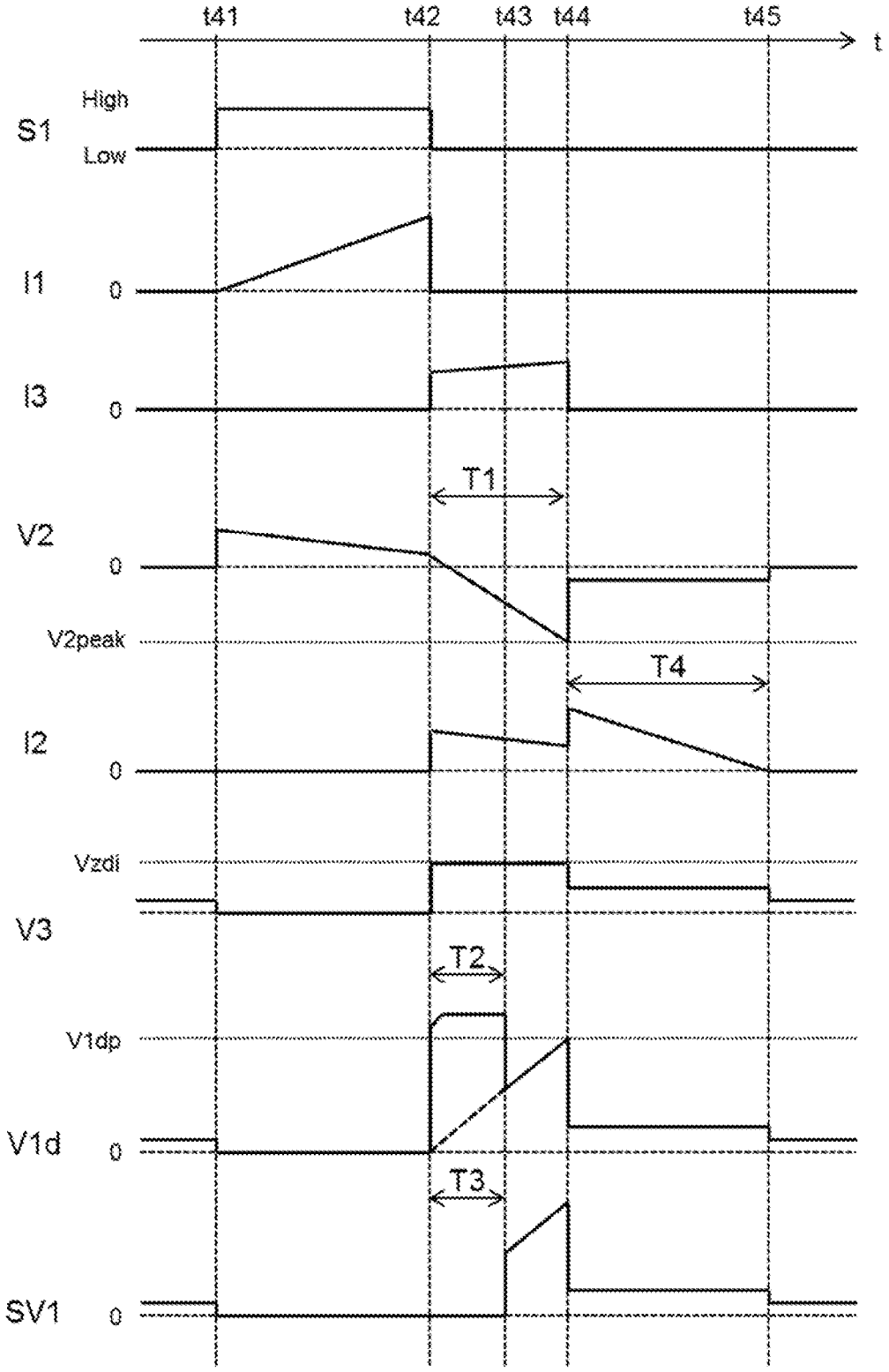
FIG. 10 is a timing chart for illustrating operation of the ignition device for an internal combustion engine of FIG. 9.

FIG. 10 is a timing chart for illustrating operation of the ignition device 10 for an internal combustion engine according to the fifth embodiment. When an ignition timing determined separately comes, the controller 50 switches the first command signal S1 for the first, switch 30 from the low level to the high level at Time t41. As a result, the primary current I1 starts to flow through the primary coil 21.

Thereafter at Time t42, the controller 50 switches the first, command signal S1 from the high level to the low level. As a result, the primary current I1 is interrupted.

Further, at Time t42, a voltage V3 generated in the adjusting coil 41 exceeds the breakdown voltage Vzdi of the Zener diode 46, and the energized state of the adjusting coil 41 becomes the ON state. As a result, the adjusting current I3 starts to flow through the adjusting coil 41.

When the adjusting coil 41 starts being energized, the secondary current I2 is generated in the secondary coil 22 in accordance with the relationship expressed by the expression (3)

At and after Time t42, electric charges are stored in the electrostatic capacitance in the path of the secondary current I2 by the secondary current I2, and the secondary voltage V2 is increased. A magnitude of the rate of change of the secondary voltage V2 at this time is smaller than a magnitude of the rate of change of the secondary voltage V2 obtained when the adjusting coil 41 is not energized.

Further, at Time t42, the primary current interruption noise is generated, and hence the output signal V1*d* of the primary voltage detector 60 is increased abruptly. The noise remover 70 detects the abrupt increase of the output signal V1*d* of the primary voltage detector 60, and starts the mask processing.

At Time t43, the primary current interruption noise stops being generated, and the output signal V1*d* of the primary voltage detector 60 is reduced abruptly. The noise remover 70 detects the abrupt reduction of the output signal V1*d* of the primary voltage detector 60, and ends the mask processing.

When the secondary voltage V2 reaches the dielectric breakdown voltage V2peak at Time t44, the dielectric breakdown occurs between the first electrode 12*a* and the second electrode 12*b* of the ignition plug 12. The controller 50 detects an abrupt reduction of the output signal SV1 of the noise remover 70, and detects the voltage value of the output signal SV1 of the noise remover 70 at this time as the peak value V1*dp*. The controller 50 obtains the dielectric breakdown voltage V2peak through conversion from the detected peak value V1*dp*.

Further, with the voltage V3 generated in the adjusting coil 41 failing below the breakdown voltage Vzdi of the Zener diode 46 at Time t44, the energized state of the adjusting coil 41 becomes the OFF state. As a result, the adjusting current I3 is interrupted, and the control for reducing the secondary current I2 ends. When the control for reducing the secondary current I2 ends at Time t44, the current value of the secondary current I2 is increased, the current value of the secondary current becomes large, and the spark discharge of high energy occurs.

When the spark discharge occurs, the magnetic energy stored in the core 23 is reduced gradually. At Time t45, the secondary current I2 stops flowing, and the spark discharge ends.

With the above-mentioned configuration, as with the ignition device according to the first embodiment, an ignition device is achieved, with which the dielectric breakdown voltage V2peak can be estimated while, in the ignition device, the current value of the secondary current becomes large at the time of the spark discharge, and the spark discharge of high energy can be caused to occur. Further, the configuration of the device is simplified as compared to the ignition device according to the first to fourth embodiments.

Sixth Embodiment

Next, an ignition device for an internal combustion engine according to a sixth embodiment is described.

Figure 11:
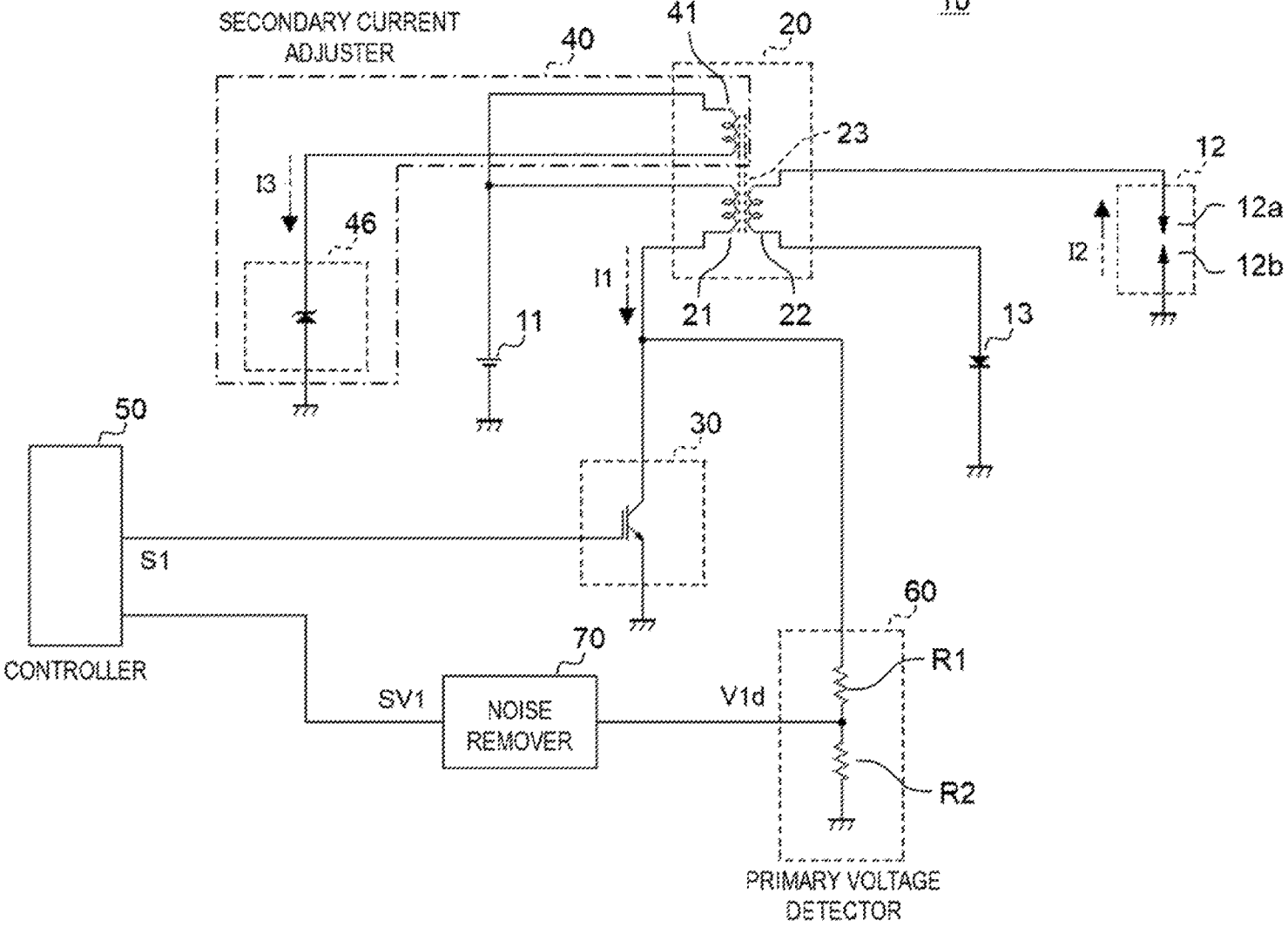
FIG. 11 is a configuration diagram for illustrating an ignition device for an internal combustion engine according to a sixth embodiment.

FIG. 11 is a configuration diagram for illustrating the ignition device for an internal combustion engine according to the sixth embodiment. The same components as the components illustrated in FIG. 1 are denoted by the same reference symbols, and a detailed description thereof is omitted.

As illustrated in FIG. 11, the secondary current adjuster 40 Includes an adjusting coil 41 and a Zener diode 46. The secondary current adjuster 40 is configured to adjust a current value of a secondary current I2 flowing through the secondary coil 22.

The adjusting coil 41 has one end connected to the positive terminal of the DC power supply 11. The negative terminal of the DC power supply 11 is grounded. The adjusting coil 41 has another end connected to the cathode of the Zener diode 46. The Zener diode 46 has the anode connected to the ground.

In other words, the configuration is similar to that in the second embodiment except that the Zener diode 46 replaces the second switch 42 and the first current limiter 43.

Further, the configuration is similar to that in the fifth embodiment except that the adjusting coil 41 has the one end connected to the positive terminal of the DC power supply 11. Therefore, operation of the ignition device according to the sixth embodiment is similar to the operation of the ignition device according to the fifth embodiment, and hence a detailed description of the operation is omitted.

With the above-mentioned configuration, as with the ignition device according to the fifth embodiment, an ignition device is achieved, with which the dielectric breakdown voltage V2peak can be estimated while, in the ignition device, the current value of the secondary current becomes large at the time of the spark discharge, and the spark discharge of high energy can be caused to occur. Further, the configuration of the device is simplified as compared to the ignition device according to the first to fourth embodiments.

In the ignition device 10 for an internal combustion engine according to the fifth and sixth embodiments, the secondary current I2 is reduced over the entirety of the charging period T1, but the period in which the secondary current I2 is reduced may be a part of the charging period T1. The period in which the secondary current I2 is reduced is adjusted through appropriate selection of a winding turns ratio between the adjusting coil 41 and the secondary coil 22, and of the breakdown voltage Vzdi of the Zener diode 46.

Further, the current value of the current flowing through the adjusting coil 41 may be limited by adding a switch, a resistor, or the like in series with the Zener diode 46.

Still further, the third switch 44 and the second current limiter 43 in the third embodiment may be replaced by a Zener diode. In other words, the third switch 44 may set the energized state of the primary coil 21 to the ON state when a voltage generated across both ends of the primary coil 21 is equal to or more than a reference voltage, and set the energized state of the primary coil 21 to the OFF state when the voltage generated across both ends of the primary coil 21 is less than the reference voltage.

Seventh Embodiment

Next, an ignition device for an internal combustion engine according to a seventh embodiment is described.

Figure 12:
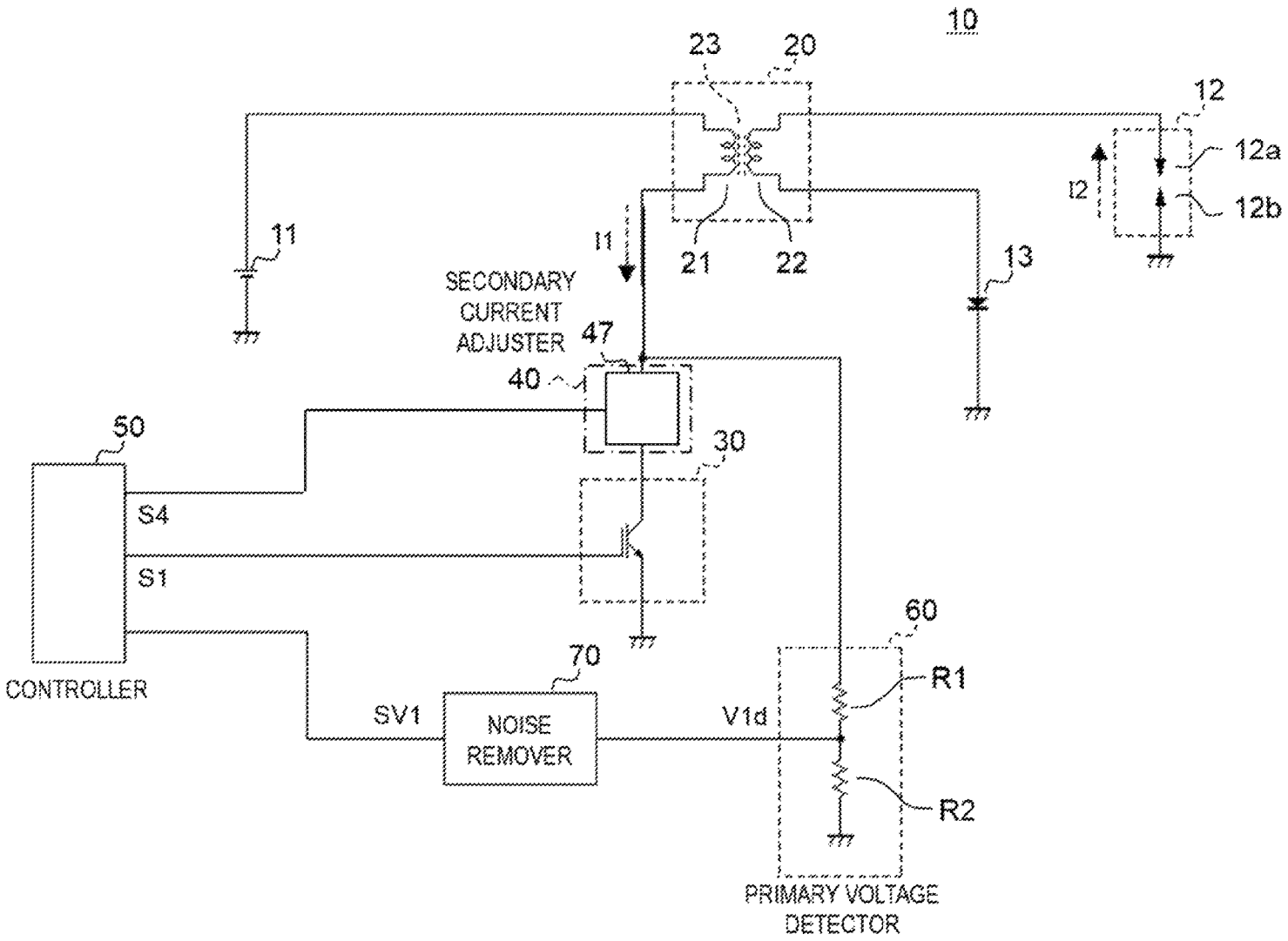
FIG. 12 is a configuration diagram for illustrating an ignition device for an internal combustion engine according to a seventh embodiment.

FIG. 12 is a configuration diagram for illustrating the ignition device for an internal combustion engine according to the seventh embodiment. The same components as the components illustrated in FIG. 1 are denoted by the same reference symbols, and a detailed description thereof is omitted.

As illustrated in FIG. 12, the secondary current adjuster 40 includes a third current limiter 47. The secondary current adjuster 40 is configured to adjust a current value of the secondary current I2 flowing through the secondary coil 22.

The primary coil 21 has one end connected to the positive terminal of the DC power supply 11. The primary coil 21 has another end connected to one end of the third current limiter 47. The third current limiter 47 has another end connected to the first switch 30.

Further, to the third current limiter 47, a fourth command signal S4 from the controller 50 is input. When the fourth command signal S4 is at a low level, a current limiting function of the third current limiter 47 is cancelled. In other words, in this case, the third current limiter 47 does not limit an electric current flowing through the primary coil 21.

When the fourth command signal S4 is at a high level, the current limiting function of the third current limiter 47 is exerted. In other words, in this case, the third current limiter 47 limits the electric current flowing through the primary coil 21 to a prescribed current value.

With the above-mentioned configuration, operation of the ignition device according to the seventh embodiment is similar to the operation of the ignition device according to the third embodiment, and hence a detailed description of the operation is omitted.

With the above-mentioned configuration, as with the ignition device according to the third embodiment, an ignition device is achieved, with which the dielectric breakdown voltage V2peak can be estimated while, in the ignition device, the current value of the secondary current becomes large at the time of the spark discharge, and the spark discharge of high energy can be caused to occur. Further, the configuration of the device is simplified as compared to the ignition device according to the first to sixth embodiments.

In the first, second, and fourth embodiments described above, the first current limiter 43 and the second switch 42 are provided separately, but the first current limiter 43 may be incorporated in the second switch 42. In the third embodiment described above, the second current limiter 45 and the third switch 44 are provided separately, but the second current limiter 45 may be incorporated in the third switch 44.

What is claimed is:

1. An ignition device for an internal combustion engine, comprising:

an ignition coil including a primary coil, a core, and a secondary coil, which is magnetically coupled to the primary coil via the core, and is configured to supply power to an ignition plug;

a first switch configured to switch an energized state of the primary coil between an ON state and an OFF state;

a secondary current adjuster configured to adjust a current value of a secondary current flowing through the secondary coil; and a controller configured to control the secondary current adjuster so that a current value of the secondary current in at least a part of a charging period of the ignition plug, which is a period from when the energized state of the primary coil is switched from the ON state to the OFF state by the first switch to when dielectric breakdown occurs in the ignition plug, becomes smaller than a peak value of the secondary current after the dielectric breakdown occurs.

2. The ignition device for an internal combustion engine according to claim 1, wherein the controller is configured to control the secondary current adjuster in at least a part of the charging period to change a rate of change of a voltage across two electrodes of the ignition plug.

3. The ignition device for an internal combustion engine according to claim 1, wherein the secondary current adjuster includes:

an adjusting coil, which is magnetically coupled to the primary coil and the secondary coil, and is energized to generate magnetic energy in the core;

a second switch configured to switch an energized state of the adjusting coil between an ON state and an OFF state; and a first current limiter configured to limit an electric current flowing through the adjusting coil to a first upper limit value or less.

4. The ignition device for an internal combustion engine according to claim 1, wherein the secondary current adjuster includes:

a third switch configured to switch an energized state of the primary coil between an ON state and an OFF state; and a second current limiter configured to limit an electric current flowing through the primary coil to a second upper limit value or less.

5. The ignition device for an internal combustion engine according to claim 3, wherein a direction of a magnetic flux generated in the core by the electric current flowing through the adjusting coil when the energized state of the adjusting coil is the ON state is the same as a direction of a magnetic flux generated in the core by an electric current, flowing through the primary coil when the energized state of the primary coil is the ON state.

6. The ignition device for an internal combustion engine according to claim 4, wherein a direction of a magnetic flux generated In the core by the electric current flowing through the primary coil When the energized state of the primary coil is set to the ON state by the third switch is the same as a direction of a magnetic flux generated in the core by the electric current flowing through the primary coil when the energized state of the primary coil is set to the ON state by the first switch.

7. The ignition device for an internal combustion engine according to claim 1, wherein the controller is configured to control the secondary current adjuster in a period at and after an end time of the charging period.

8. The ignition device for an internal combustion engine according to claim 7, wherein the secondary current adjuster includes:

an adjusting coil, which is magnetically coupled to the primary coil and the secondary coil, and is energized to generate magnetic energy in the core;

a second switch configured to switch an energized state of the adjusting coil between an ON state and an OFF state; and a first current limiter configured to limit an electric current flowing through the adjusting coil to a first upper limit value or less.

9. The ignition device for an internal combustion engine according to claim 8, wherein a direction of a magnetic flux generated in the core by the electric current flowing through the adjusting coil when the energized state of the adjusting coil is the ON state is opposite to a direction of a magnetic flux generated in the core by an electric current flowing through the primary coil when the energized state of the primary coil is the ON state.

10. The ignition device for an internal combustion engine according to claim 3 wherein the controller is configured to keep, when the energized state of the adjusting coil is the ON state, a current value of the electric current flowing through the adjusting coil constant by the first current limiter.

11. The ignition device for an internal combustion engine according to claim 4, wherein the controller is configured to keep, when the energized state of the primary coil is set to the ON state by the third switch, a current value of the electric current flowing through the primary coil constant by the second current limiter.

12. The ignition device for an internal combustion engine according to claim 3, wherein the second switch is configured to set the energized state of the adjusting coil to the ON state when a voltage generated across both ends of the adjusting coil is equal to or more than a reference voltage, and set the energized state of the adjusting coil to the OFF state when the voltage generated across the both ends of the adjusting coil is less than the reference voltage.

13. The ignition device for an internal combustion engine according to claim 12, wherein the second switch is a Zener diode.

14. The ignition device for an internal combustion engine according to claim 4, wherein the third switch is configured to set the energized state of the primary coil to the ON state when a voltage generated across both ends of the primary coil is equal to or more than a reference voltage, and set the energized state of the primary coil to the OFF state when the voltage generated across the both ends of the primary coil is less than the reference voltage.

15. The ignition device for an internal combustion engine according to claim 14, wherein the third switch is a Zener diode.

16. The ignition device for an internal combustion engine according to claim 1, further comprising a primary voltage detector configured to detect a primary voltage, which is generated at a coil end of the primary coil that is opposite to a coil end of the primary coil that is connected to a DC power supply.

17. The ignition device for an internal combustion engine according to claim 16, wherein the controller is configured to:

calculate a dielectric breakdown voltage, which is a voltage across electrodes of the ignition plug obtained when the dielectric breakdown occurs in the ignition plug, based on the primary voltage acquired by the primary voltage detector;

predict the dielectric breakdown voltage in a current ignition cycle based on the dielectric breakdown voltage calculated in a past ignition cycle and current operation conditions of the internal combustion engine;

estimate the charging period based on the predicted dielectric breakdown voltage and a rate of change of the voltage across the electrodes of the ignition plug; and control the secondary current adjuster when the estimated charging period is shorter than a period in which it is estimated that primary current interruption noise, which is noise generated when a primary current flowing through the primary coil is interrupted, is generated.

18. The ignition device for an internal combustion engine according to claim 2, wherein the controller is configured to set, when an abnormal discharge occurs in the ignition plug, a current value of the secondary current in a period in which the secondary current is adjusted with use of the secondary current adjuster, to a current value that is larger than a current value of the secondary current obtained when the ignition plug discharges normally.

19. The ignition device for an internal combustion engine according to claim 16, further comprising a noise remover configured to remove primary current interruption noise, which is noise generated when an electric current flowing through the primary coil is interrupted, from an output signal of the primary voltage detector.

20. The ignition device for an internal combustion engine according to claim 19, wherein the noise remover is configured to set a mask period to include a noise generation period, which is a period in which the primary current interruption noise is generated, and mask the output signal of the primary voltage detector in the mask period to remove the primary current interruption noise.

* * * * *